US012805606B2

(12) United States Patent
Dunning et al.

(10) Patent No.: US 12,805,606 B2
(45) Date of Patent: Nov. 24, 2026

(54) ARTICLE OF FOOTWEAR HAVING SELF-TIGHTENING MECHANICS

(71) Applicant: PUMA SE, Herzogenaurach (DE)

(72) Inventors: Christopher Dunning, Herzogenaurach (DE); Sidney Fauconnier, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 17/720,497

(22) Filed: Apr. 14, 2022

(65) Prior Publication Data

US 2022/0330661 A1 Oct. 20, 2022

Related U.S. Application Data

(60) Provisional application No. 63/215,791, filed on Jun. 28, 2021, provisional application No. 63/175,879, filed on Apr. 16, 2021.

(51) Int. Cl.

| | |
|---|---|
| ***A43B 7/20*** | (2006.01) |
| ***A43C 11/00*** | (2006.01) |
| ***A43C 11/22*** | (2006.01) |

(52) U.S. Cl.

CPC ..... *A43C 11/22* (2013.01); *A43B 7/20* (2013.01); *A43C 11/00* (2013.01)

(58) Field of Classification Search

CPC ..... A43C 11/00; A43C 11/22; A43C 1/003
See application file for complete search history.

(56) References Cited

U.S. PATENT DOCUMENTS

| | | | | | |
|---|---|---|---|---|---|
| 1,155,506 | A | * | 10/1915 | Osaki | A43B 7/32 36/89 |
| 1,443,844 | A | * | 1/1923 | Jensen | A61F 13/066 602/66 |
| 2,358,474 | A | | 9/1944 | Pope | |
| 3,000,119 | A | * | 9/1961 | Altman | A43C 11/00 24/3.2 |
| 4,461,288 | A | * | 7/1984 | Curtis | A61F 5/0111 602/23 |
| 4,476,639 | A | * | 10/1984 | Zaccaria | A43C 11/1493 36/114 |

(Continued)

FOREIGN PATENT DOCUMENTS

| | | | |
|---|---|---|---|
| CN | 209391156 | U | 9/2019 |
| EP | 0372452 | A1 | 6/1990 |

(Continued)

OTHER PUBLICATIONS

International Search Report of International Application No. PCT/IB2022/053549, mailed Jun. 17, 2022 (6 pages).

(Continued)

*Primary Examiner* — Katharine G Kane
(74) *Attorney, Agent, or Firm* — Quarles & Brady, LLP

(57) ABSTRACT

An article of footwear includes a front end, a rear end, a sole structure, an upper attached to the sole structure, and a strap system engaged with the upper. The upper defines a forefoot region, a midfoot region, and a heel region of the article of footwear, and the upper and the sole structure together define an interior cavity. The strap system comprises a strap configured to tighten portions of the upper within the heel region in response to the user's toe movement within the interior cavity.

11 Claims, 12 Drawing Sheets

(56) References Cited

U.S. PATENT DOCUMENTS 4,592,154 A * 6/1986 Oatman ..... A43B 5/00 36/114
4,649,939 A * 3/1987 Curtis ..... A43B 7/19 36/89
4,670,999 A 6/1987 Olivieri
4,811,498 A * 3/1989 Barret ..... A43B 5/0411 36/117.7
4,811,500 A * 3/1989 Maccano ..... A43B 5/00 36/91
4,924,605 A * 5/1990 Spademan ..... A43B 5/0441 36/114
5,311,678 A 5/1994 Spademan
5,323,549 A * 6/1994 Segel ..... A43B 7/1495 36/170
5,704,138 A * 1/1998 Donnadieu ..... A43B 5/002 36/50.1
5,771,608 A * 6/1998 Peterson ..... A43B 7/20 36/89
5,839,210 A * 11/1998 Bernier ..... A43C 11/00 36/138
6,035,556 A 3/2000 Ballinger et al.
6,073,370 A * 6/2000 Okajima ..... A43B 11/00 36/89
6,378,230 B1 4/2002 Rotem et al.
6,772,541 B1 * 8/2004 Ritter ..... A43C 11/14 36/91
8,087,188 B2 1/2012 Labbe
9,622,543 B2 4/2017 Ramos et al.
9,999,278 B2 6/2018 Feinstein
10,271,616 B2 4/2019 Labbe
10,278,454 B2 * 5/2019 Kohatsu ..... A43B 5/00
10,537,154 B2 1/2020 Smith et al.
10,827,797 B2 * 11/2020 Hsu ..... A43C 11/1493
2002/0174568 A1 11/2002 Neiley
2003/0066207 A1 * 4/2003 Gaither ..... A43C 1/04 36/50.1
2005/0126042 A1 * 6/2005 Baier ..... A43C 11/00 36/50.1
2005/0198867 A1 9/2005 Labbe
2005/0268485 A1 * 12/2005 Sakai ..... A43B 7/18 36/11.5
2006/0053659 A1 * 3/2006 Johnson ..... A43C 7/00 36/25 R
2007/0130800 A1 * 6/2007 Twomey ..... A43B 3/16 36/89
2007/0209234 A1 9/2007 Chou
2012/0117821 A1 * 5/2012 Adams ..... A43B 3/0052 36/58.5
2013/0255105 A1 * 10/2013 Bishop ..... A43B 23/07 36/25 R
2016/0029746 A1 * 2/2016 Rushbrook ..... A43C 1/06 36/97
2016/0338449 A1 * 11/2016 Steuerwald ..... A43B 5/14
2016/0343240 A1 * 11/2016 Chuang ..... A43C 11/00
2017/0071285 A1 * 3/2017 Syed ..... A43B 7/24
2017/0273403 A1 * 9/2017 Pauk ..... A43B 13/181
2019/0307203 A1 * 10/2019 Carlson ..... A43B 7/1445
2020/0068995 A1 * 3/2020 Juckelandt ..... A43B 1/10

FOREIGN PATENT DOCUMENTS

JP 5348811 B1 11/2013
KR 20180065089 A 6/2018
WO 2003039283 A1 5/2003

OTHER PUBLICATIONS

Written Opinion of International Application No. PCT/IB2022/053549, mailed Jun. 17, 2022 (8 pages).

* cited by examiner

ARTICLE OF FOOTWEAR HAVING SELF-TIGHTENING MECHANICS

CROSS REFERENCE TO RELATED APPLICATIONS

This application claims priority to U.S. Provisional Patent Application No. 63/175,879, filed on Apr. 16, 2021, entitled "Article of Footwear Having Bodyweight Tightening Mechanics," and U.S. Provisional Patent Application No. 63/215,791, filed on Jun. 28, 2021, entitled "Article of Footwear Having Self-Tightening Mechanics," the contents of which are incorporated by reference herein in their entirety and are to be considered a part of this application.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a strap system for automatically tightening regions of the article of footwear in response to a wearer's foot movement.

2. Description of the Background

Many conventional shoes or articles of footwear generally comprise an upper and a sole attached to the upper. Conventional shoes further include an internal space, i.e., a void or cavity, which is created by interior surfaces of the upper and sole, that receives a foot of a user before securing the shoe to the foot. The sole is attached to a lower surface of the upper and is positioned between the upper and the ground. As a result, the sole typically provides stability and cushioning to the user when the shoe is being worn and/or is in use. In some instances, the sole may include multiple components, such as an outsole, a midsole, and an insole. The outsole may provide traction to a bottom surface of the sole, and the midsole may be attached to an inner surface of the outsole, and may provide cushioning and/or added stability to the sole. For example, a sole may include a particular foam material that may increase stability at one or more desired locations along the sole, or a foam material that may reduce stress or impact energy on the foot and/or leg when a user is running, walking, or engaged in another activity.

The upper generally extends upward from the sole and defines an interior cavity that completely or partially encases a foot. In most cases, an upper extends over instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, the tongue being provided to allow for adjustment of shoe tightness. The tongue may further be manipulated by a user to permit entry and/or exit of a foot from the internal space or cavity. In addition, the lacing system may allow a user to adjust certain dimensions of the upper and/or the sole.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region to provide a higher degree of resistance or rigidity. In contrast, other portions of a shoe may include a soft woven textile to provide an area with stretch-resistance, flexibility, air-permeability, or moisture-wicking properties.

The materials distributed among various portions of the upper generally provide certain support features (e.g., rigidity, flexibility, stretch-resistance, etc.) regardless of a user's foot and/or ankle movement. Further, lacing systems are generally meant to maintain the upper in a specific orientation with a desired tightness once laced. However, it may be desirable to utilize a footwear system that automatically adapts to a wearer. For example, it may be desirable to utilize a system that automatically adjusts the upper to secure the article of footwear to the wearer based on, for example, the wearer's foot movement. More specifically, it may be desirable to include a system that automatically adjusts upper tightness around regions of the foot and/or ankle based on the user's foot movement to help secure the shoe to the user's foot and/or help release the user's foot from the shoe.

Therefore, articles of footwear having systems with mechanics capable of automatic upper adjustments based on user's foot movement may be desired.

SUMMARY

An article of footwear, as described herein, may have various configurations. In some embodiments, an article of footwear includes a front end, a rear end, a sole structure, an upper attached to the sole structure, and a strap system engaged with the upper. The upper defines a forefoot region, a midfoot region, and a heel region of the article of footwear, and the upper and the sole structure together define an interior cavity. The strap system comprises a strap extending around the heel region and configured to tighten portions of the upper in response to the user's foot engaging the strap system within the interior cavity in the forefoot region or the midfoot region.

In some embodiments, the strap system comprises a rail and a strap. The rail is positioned at least partially within the interior cavity and includes a base portion. The base portion is movable between a first position and a second position based on the user's toe movement within the interior cavity. The strap is coupled to the rail and configured to tighten the portions of the upper based on a location of the base portion.

In some embodiments, the base portion is positioned adjacent the front end and includes a front portion configured to engage a distal end of at least one toe of the user when the user's foot is within the interior cavity. Additionally, in some embodiments, the base portion further includes a bump configured to engage an underside of at least one toe of the user when the user's foot is within the interior cavity.

In some embodiments, the rail further includes a cover portion coupled to the base portion. Furthermore, in some embodiments, the cover portion includes a strap engagement configured to engage the strap. In some embodiments, the rail is moveable relative to the cover portion. In some embodiments, the cover portion is embedded within the upper.

In some embodiments, the strap comprises a stirrup region and a tightening region. The stirrup region is positioned within the interior cavity and comprises a loop that receives the user's foot as it is inserted into the article of footwear. The tightening region is positioned outside the interior cavity and is coupled to the stirrup region. The tightening region is engaged with the upper in order to cause the upper to tighten around the user's foot along the midfoot region and the heel region of the upper in response to movement of the stirrup region.

In some embodiments, the tightening region crosses over itself in the midfoot region and loops around the heel region. Additionally, in some embodiments, the tightening region includes a crossing portion above the stirrup region, a heel portion adjacent the heel region, a lateral portion that extends from the crossing portion to the heel portion along a lateral side of the upper, and a medial portion that extends from the crossing portion to the heel portion along a medial side of the upper.

In some embodiments, the loop is moveable between a first position suspended within the interior cavity between the upper and the sole structure, and a second position adjacent the sole structure. Additionally, in some embodiments, the tightening region is pulled toward the interior cavity when the loop moves from the first position to the second position, causing the upper to tighten around the user's foot. Furthermore, in some embodiments, the loop is positioned within the midfoot region and the tightening region is positioned within the midfoot region and the heel region.

In some embodiments, the strap is configured to tighten the portions of the upper within the midfoot region and the heel region in response to the user's foot engaging the strap system within the interior cavity. Additionally, in some embodiments, the upper comprises a first aperture extending therethrough and a second aperture extending therethrough, and wherein the strap extends from the interior cavity to outside of the interior cavity through the first aperture and the second aperture.

In some embodiments, a method of self-tightening an article of footwear to a foot of a user is provided. The method includes providing a strap system engaged with an upper of the article of footwear. The strap system comprises a stirrup region and a tightening region coupled to the stirrup region and positioned within a midfoot region and a heel region of the article of footwear. The method also includes receiving the foot through the stirrup region within an interior cavity of the article of footwear and causing the stirrup region to press into the interior cavity in response to the user's bodyweight as the foot is pressed against the stirrup region within the interior cavity. The method further includes pulling the tightening region in response to the stirrup region pressing into the interior cavity, and tightening regions of the upper engaged with the tightening region around the foot within the midfoot region and the heel region as a result of the tightening region being pulled.

In some embodiments, a method of self-tightening an article of footwear to a foot of a user through a strap system engaged with an upper of the article of footwear is provided. The strap system comprises a rail and a strap coupled to the rail. The method includes receiving the foot within an interior cavity of the article of footwear and causing the rail to move within the interior cavity toward a front end of the article of footwear in response to movement of the user's toe within the interior cavity. The method further includes pulling the strap, positioned within at least a heel region of the article of footwear, in response to the rail moving toward the front end, and tightening regions of the upper engaged with the strap around the foot within the heel region as a result of the strap being pulled.

In some embodiments, the method further includes causing the rail to move within the interior cavity toward a rear end of the article of footwear in response to movement of the user's toe within the interior cavity, releasing the strap in response to the rail moving toward the rear end, and loosening regions of the upper engaged with the strap around the foot within the heel region as a result of the strap being released.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

DETAILED DESCRIPTION OF THE DRAWINGS

Figure 1:
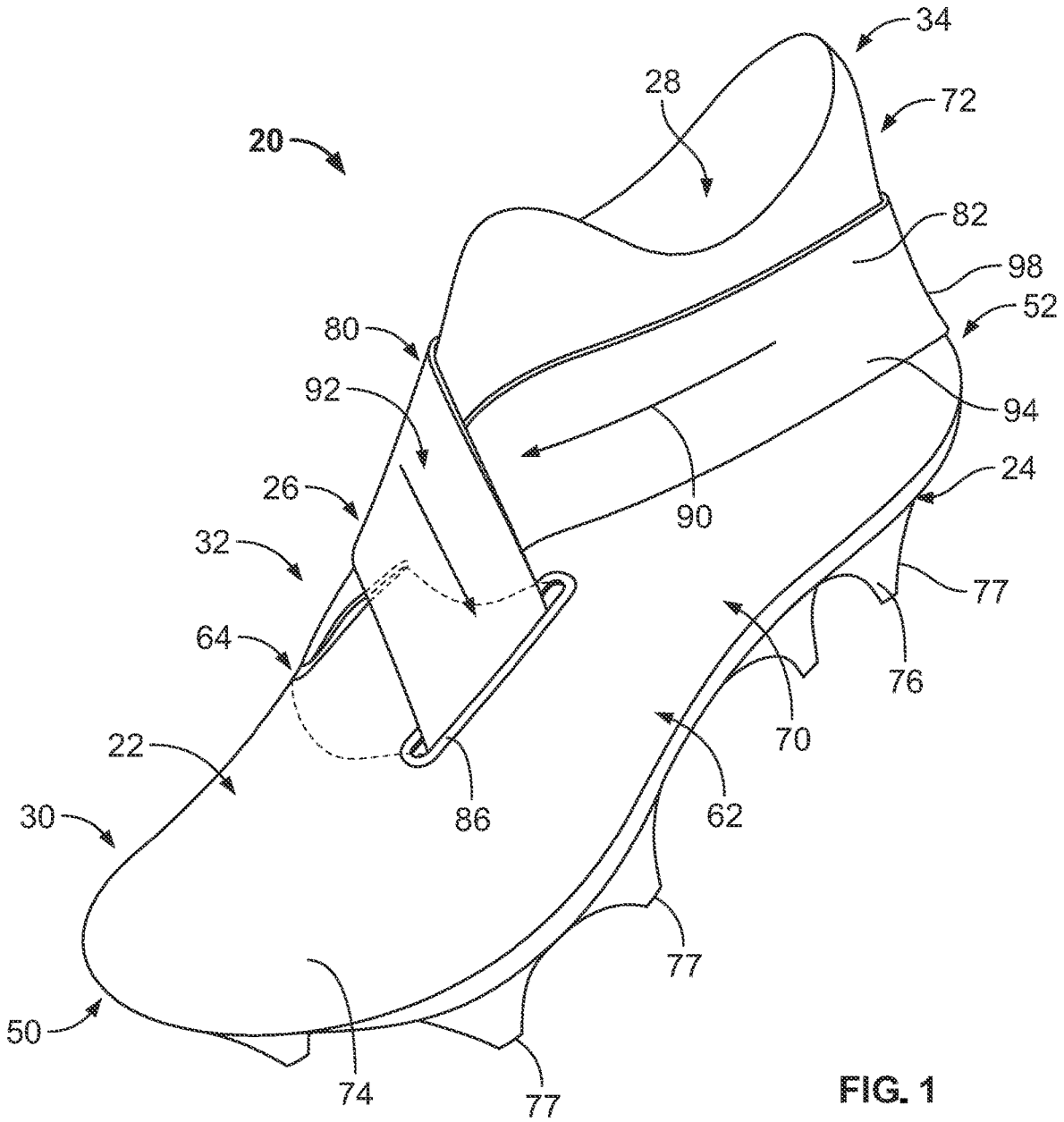
FIG. 1 is a lateral view of a left shoe comprising a strap system according to a first configuration.

The following discussion and accompanying figures disclose various embodiments or configurations of a shoe and a self-tightening system for the shoe. Although embodiments are disclosed with reference to a sports shoe, such as a running shoe, tennis shoe, basketball shoe, soccer shoe or cleat, football shoe, track cleat, golf shoe, etc., concepts associated with embodiments of the shoe may be applied to a wide range of footwear and footwear styles, including cross-training shoes, hiking shoes, hiking boots, ski and snowboard boots, and walking shoes, for example. Concepts of the shoe or the automatic tightening system may also be applied to articles of footwear that are considered non-athletic, including dress shoes, sandals, loafers, slippers, and heels. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear and/or specific components of the article of footwear, such as an upper and/or a sole or sole structure, and self-tightening strap system. The strap system causes the article of footwear, such as portions of an upper, to self-tighten or loosen around the user's foot based on the user's movement relative to the strap system. That is, the interaction of a user's foot with the strap system causes the article of footwear to self-tighten or self-loosen around the foot. For example, in some instances, such interaction may be the user's foot being inserted into the article of footwear, such that the article of footwear self-tightens around the foot in response to the user's bodyweight. In some instances, such interaction may be the user's toes engaging the strap system to cause the article of footwear to self-tighten and/or self-loosen around the foot.

Accordingly, FIGS. 1-15B depict articles of footwear 20 each having an upper 22, a sole structure 24, and a strap system 26 engaged with the upper 22. As will be further discussed herein, the upper 22 is attached to the sole structure 24 such that the components define an interior cavity 28 (e.g., shown in FIGS. 1, 3, 4, 9, and 13) into which a foot 36 (e.g., shown in FIGS. 2, 6, 7, 8, 12, and 14A-15B) of a user may be inserted. The strap system 26 includes one or more straps or harnesses configured to cause the upper 22 to tighten around the foot 36 in response to the foot's movement within the interior cavity 28. FIGS. 1-11 depict an article of footwear 20, according to a first configuration, having a strap system 26 engaged by bodyweight via a mid-region or arch 46 of a foot 36, while FIGS. 12-15B depict an article of footwear 20, according to a second configuration, having a strap system 26 engaged by toes 38 of a foot 36.

With further reference to the bodyweight tightening configuration of FIGS. 1-11, FIG. 1 depicts an article of footwear 20, configured as a left shoe, with an upper 22, a sole structure 24, and a strap system 26 engaged with the upper 22. As will be further discussed herein, the upper 22 is attached to the sole structure 24 such that the components define an interior cavity 28 into which a foot of a user may be inserted. The strap system 26 includes one or more straps or harnesses configured to extend into the interior cavity 28 and around portions of the upper 22. The article of footwear 20 may also include additional components not specifically addressed herein. Furthermore, FIGS. 3-11 further depict the article of footwear 20, in part or in whole, in various configurations.

As discussed in greater detail below, the article of footwear 20 of FIGS. 1-11 and, in particular, the strap system 26, is intended to actively tighten around a user's foot upon receiving a user's bodyweight. More specifically, as the user's foot is inserted into the article of footwear 20 and through the strap system 26, the user's bodyweight forces a portion of the strap system 26 within the interior cavity 28 toward the sole structure 24, causing other portions of the strap system 26 to tighten around the user's foot, heel, and/or ankle. These and other features will be described in greater detail below.

Figure 3:
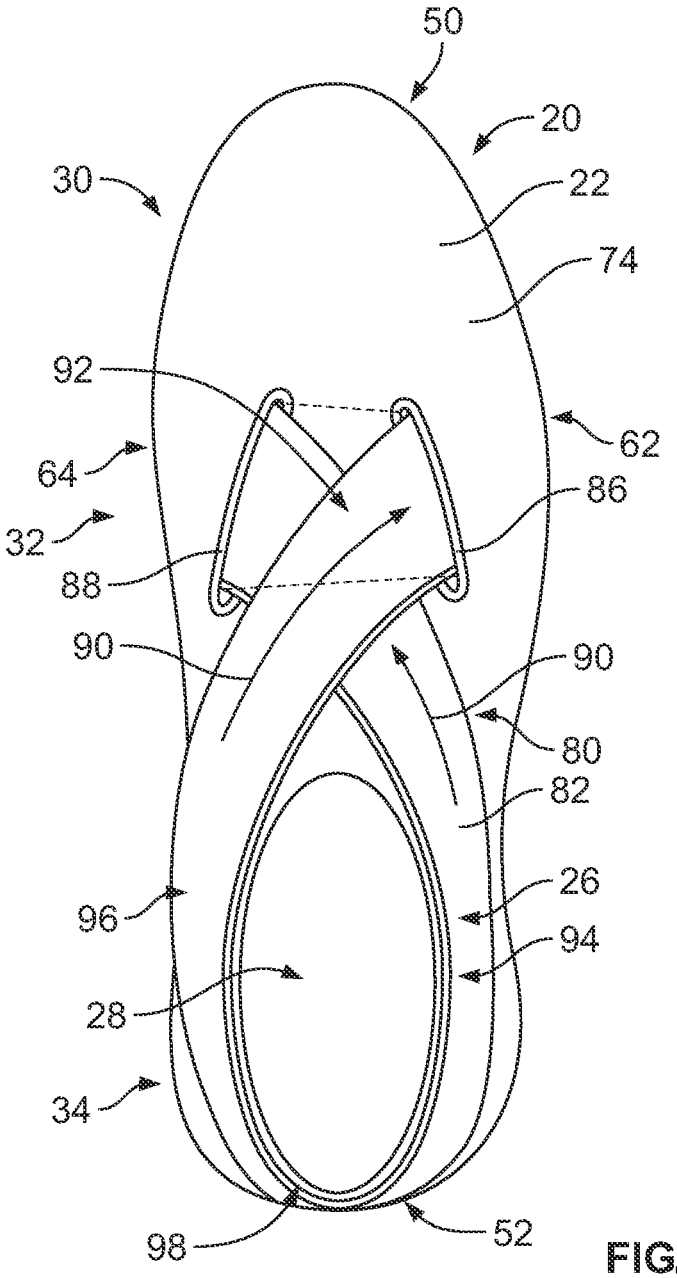
FIG. 3 is a topside view of a right shoe comprising a strap system according to a first configuration.
Figure 4:
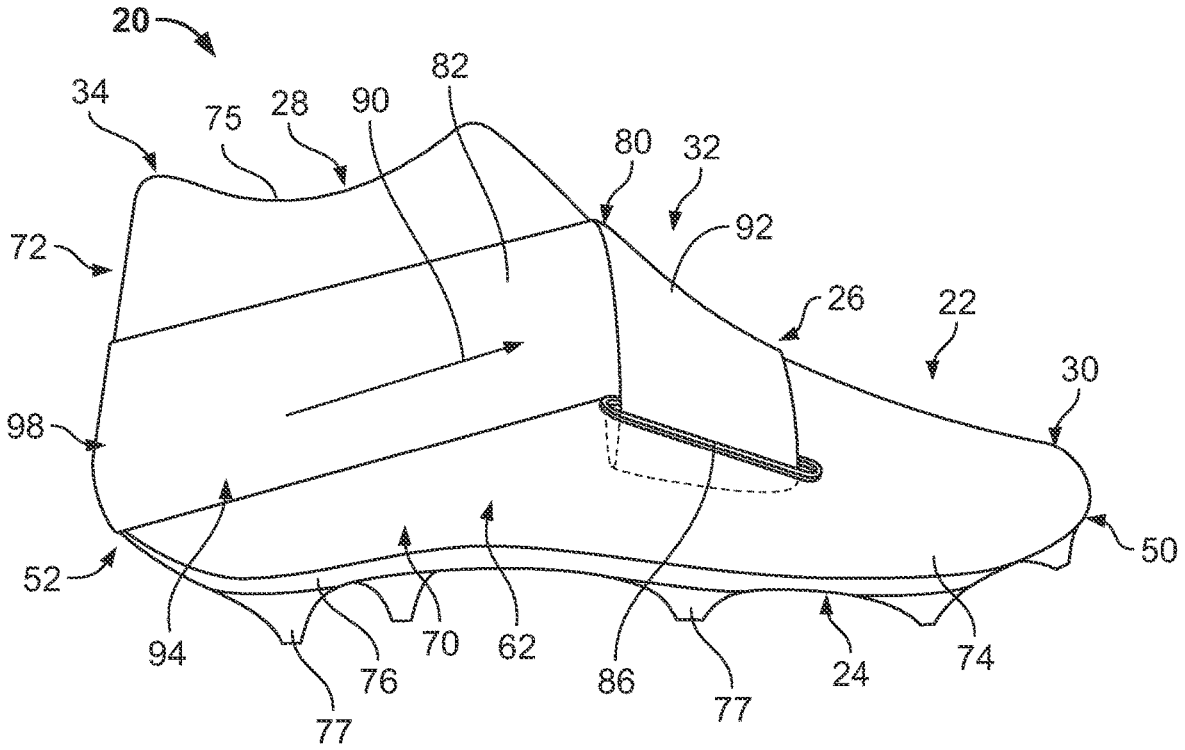
FIG. 4 is a side view of the right shoe of FIG. 3.

Though the article of footwear 20 is depicted in FIG. 1 as a single, left shoe 20, the article of footwear 20 may be part of a pair of articles of footwear 20 (e.g., a footwear assembly) comprising a first or left shoe (shown in FIGS. 1, 5, 6, 7, 8, 9, and 10) and a second or right shoe (shown in FIGS. 3 and 4). The left shoe and the right shoe may be similar in all material aspects, except that the left shoe and the right shoe are sized and shaped to receive a left foot and a right foot of a user, respectively. Thus, for ease of disclosure, a single shoe, or article of footwear 20, will be referenced to describe aspects of the disclosure. More specifically, the disclosure herein with reference to the article of footwear 20 is applicable to both the left shoe and the right shoe, though the article of footwear 20 is depicted as a right shoe in some figures and as a left shoe in other figures. In some embodiments, there may be differences between the left shoe and the right shoe other than the left/right configuration, or the left shoe may include one or more additional elements that the right shoe does not include, or vice versa.

Figure 2:
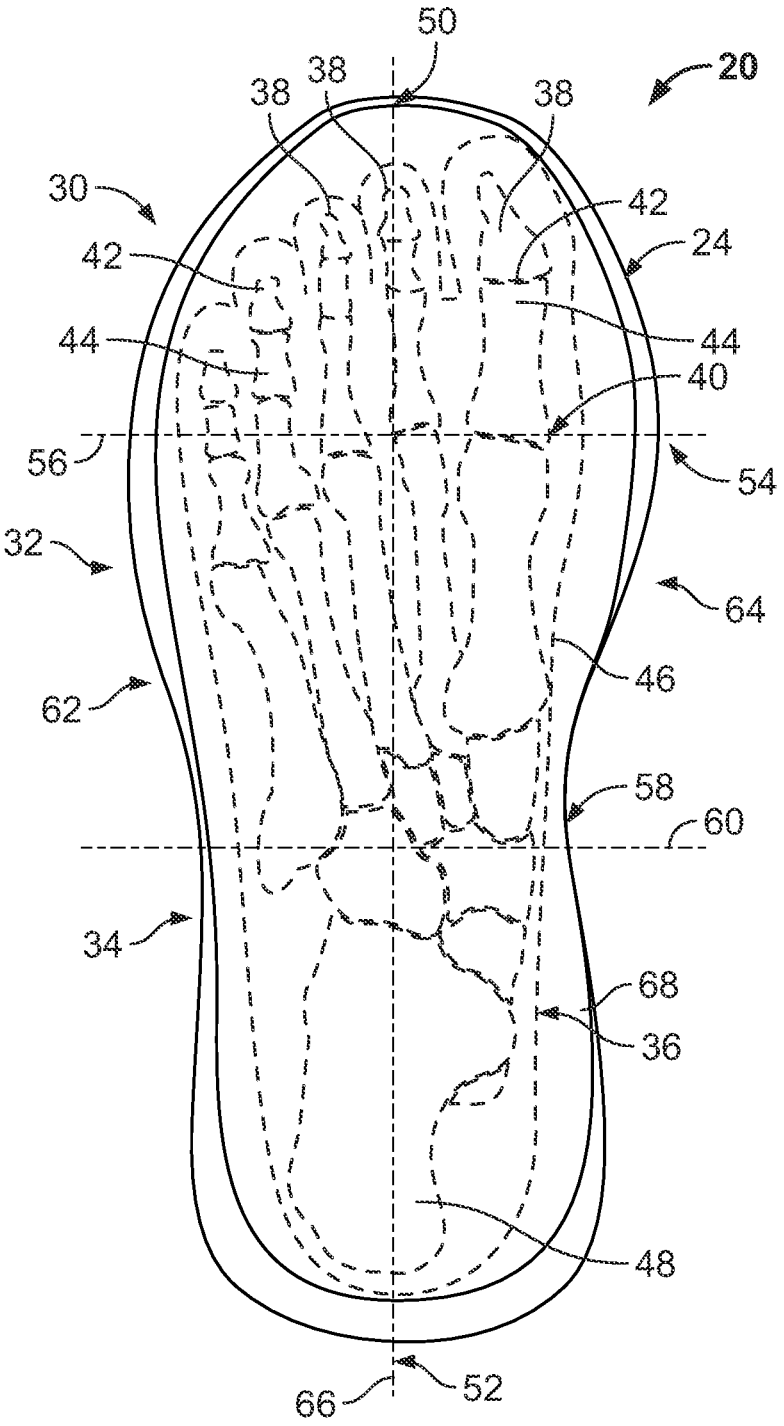
FIG. 2 is an underside view of an article of footwear, with portions of an outsole and midsole removed and a user's skeletal foot structure overlaid thereon.

Unless otherwise specified, with reference to FIG. 2, the article of footwear 20 may be defined by a forefoot region 30, a midfoot region 32, and a heel region 34. The forefoot region 30 may generally correspond with portions of the article of footwear 20 that encase portions of a foot 36 that include the toes or phalanges 38, the ball of the foot 40, and one or more of the joints 42 that connect the metatarsals 44 of the foot 36 with the toes or phalanges 38. The midfoot region 32 is proximate and adjoins the forefoot region 30. The midfoot region 32 generally corresponds with portions of the article of footwear 20 that encase an arch 46 of the foot 36, along with an instep or bridge 47 of the foot (e.g., a top of the foot opposite the arch 46, shown in FIG. 8). The heel region 34 is proximate to the midfoot region 32 and adjoins the midfoot region 32. The heel region 34 generally corresponds with portions of the article of footwear 20 that encase rear portions of the foot 36, including the heel or calcaneus bone 48, the ankle 49 (shown in FIG. 9), and/or the Achilles tendon (not shown).

Still referring to FIG. 2, the forefoot region 30, the midfoot region 32, and the heel region 34 collectively span an entire length of the article of footwear 20, from a front end 50 (e.g., adjacent the toes 38 of the user) to a rear end 52 (e.g., adjacent the heel 48 of the user). The forefoot region 30 extends from the front end 50 to a widest portion 54 of the article of footwear 20. The widest portion 54 may be defined or measured along a first line 56, as shown in FIG. 2. The midfoot region 32 extends from the widest portion 54 to a thinnest portion 58 of the article of footwear 20 (which may be defined or measured along a second line 60, as shown in FIG. 2). The heel region 34 extends from the thinnest portion 58 to the rear end 52 of the article of footwear 20.

Referring still to FIG. 2, the article of footwear 20 also defines a lateral side 62 and a medial side 64, the lateral side 62 being shown in FIGS. 1, 3, and 4, and the medial side 64 being shown in FIGS. 5, 6, 7, 8, 9, and 10. When a user is wearing the article of footwear 20, the lateral side 62 corresponds with an outside-facing portion of the article of footwear 20 while the medial side 64 corresponds with an inside-facing portion of the article of footwear 20. As such, the left shoe and the right shoe have opposing lateral sides 62 and medial sides 64, such that the medial sides 64 are closest to one another when a user is wearing the shoes 20, while the lateral sides 62 are defined as the sides that are farthest from one another while the shoes 20 are being worn.

Generally, the medial side 64 and the lateral side 62 adjoin one another along a longitudinal central plane or axis 66 of the article of footwear 20. As such, the longitudinal central plane or axis 66 may demarcate a central, intermediate axis between the medial side 64 and the lateral side 62. Put differently, the longitudinal plane or axis 66 may extend between the rear end 52 of the article of footwear 20 and the front end 50 of the article of footwear 20 and may continuously define a middle of an insole 68, the sole structure 24, and/or the upper 22 of the article of footwear 20, i.e., the longitudinal plane or axis 66 is a straight axis extending from the rear end 52 at the heel region 34 to the front end 50 at the forefoot region 30. Furthermore, the longitudinal plane or axis 66 may be perpendicular to the first line 56 and the second line 60.

Still referring to FIG. 2, the medial side 64 begins at the front end 50 at the longitudinal, central axis 66 and bows outward along an inner side of the article of footwear 20 along the forefoot region 30 toward the midfoot region 32. The medial side 64 reaches the first line 56, at which point the medial side 64 enters into the midfoot region 32 (i.e., upon crossing the first line 56), and bows inward, toward the central, longitudinal axis 66. That is, the medial side 64 extends from the first line 56, e.g., the widest portion 54 of the shoe 20, toward the second line 60, e.g., the thinnest portion 58 of the shoe 20. Once reaching the second line 60, at which point the medial side 64 extends into the heel region 34 (i.e., upon crossing the second line 60), the medial side 64 bows outward, away from the longitudinal, central axis 66. The medial side 64 then bows back inward toward the rear end 52, and terminates at a point where the medial side 64 meets the longitudinal, central axis 66.

The lateral side 62 also begins at the front end 50 at the longitudinal, central axis 66 and bows outward along an outer side of the article of footwear 20 (i.e., opposite the inner side) along the forefoot region 30 toward the midfoot region 32. The lateral side 62 reaches the first line 56, at which point the lateral side 62 enters into the midfoot region 32 (i.e., upon crossing the first line 56), and bows inward, toward the longitudinal, central axis 66. That is, the lateral side 62 extends from the first line 56, e.g., the widest portion 54, toward the second line 60, e.g., the thinnest portion 58. Once reaching the second line 60, the lateral side 62 extends into the heel region 34 (i.e., upon crossing the second line 60) and bows outward, away from the longitudinal, central axis 66. The lateral side 62 then bows back inward toward the rear end 52, and terminates at a point where the lateral side 62 meets the longitudinal, central axis 66.

Still referring to FIG. 2, the forefoot region 30, the midfoot region 32, the heel region 34, the lateral side 62, and the medial side 64 are intended to define boundaries or areas of the article of footwear 20. To that end, the forefoot region 30, the midfoot region 32, the heel region 34, the lateral side 62, and the medial side 64 generally characterize sections of the article of footwear 20. Certain aspects of the disclosure may refer to portions or elements that are coextensive with one or more of the forefoot region 30, the midfoot region 32, the heel region 34, the lateral side 62, and/or the medial side 64. Further, the upper 22, the sole structure 24, and the strap system 26 may be characterized as having portions within the forefoot region 30, the midfoot region 32, the heel region 34, and/or along the lateral side 62 and/or the medial side 64. In other words, the upper 22, the sole structure 24, and the strap system 26, and/or individual portions of the upper 22, the sole structure 24, and the strap system 26 may be disposed within the forefoot region 30, the midfoot region 32, the heel region 34, and/or along the lateral side 62 and/or the medial side 64.

It should be understood that numerous modifications may be apparent to those skilled in the art in view of the foregoing description, and individual components thereof, may be incorporated into numerous articles of footwear. Accordingly, aspects of the article of footwear 20 and components thereof, may be described with reference to general areas or portions of the article of footwear 20, with an understanding that the boundaries of the forefoot region 30, the midfoot region 32, the heel region 34, the lateral side 62, and/or the medial side 64 as described herein may vary between articles of footwear. Furthermore, aspects of the article of footwear 20 and individual components thereof, may also be described with reference to exact areas or portions of the article of footwear 20 and the scope of the appended claims herein may incorporate the limitations associated with these boundaries of the forefoot region 30, the midfoot region 32, the heel region 34, the lateral side 62, and/or the medial side 64 discussed herein.

Figure 8:
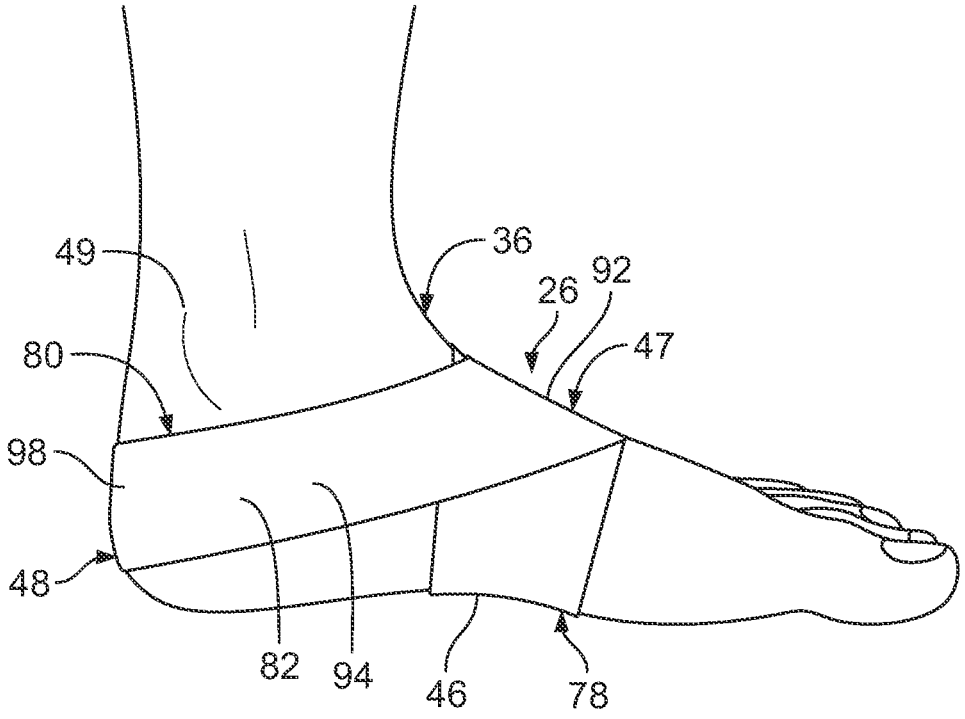
FIG. 8 is a side view of a user's foot with the strap system of the shoe of FIG. 1 engaged around the foot.
Figure 9:
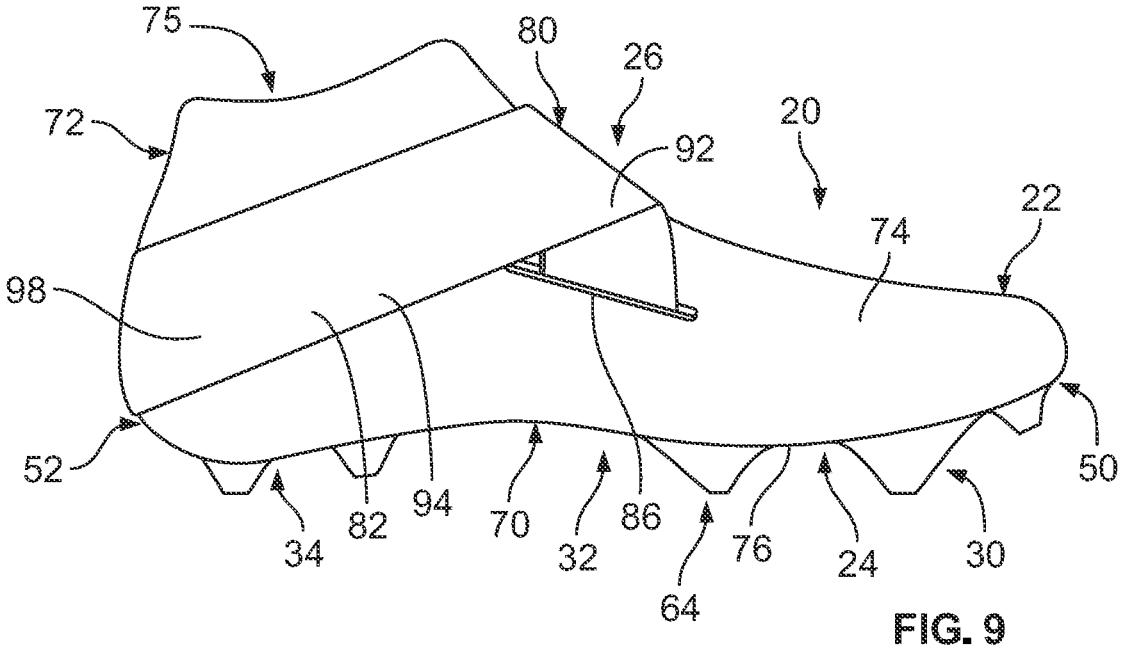
FIG. 9 is a side view of the left shoe of FIG. 1 with a user's foot secured therein.

With reference now to the upper 22, as shown in FIGS. 1, 3, 4, 5, and 9, the upper 22 generally extends upwardly from the sole structure 24 and defines the interior cavity 28 that receives and helps secure a foot 36 of a user. The upper 22 may be defined by a foot region 70 and an ankle region 72. Collectively, the foot region 70 and the ankle region 72 may completely or partially encase a user's foot and/or portions of the user's ankle. In general, the foot region 70 extends upwardly from the sole structure 24 and through the forefoot region 30, the midfoot region 32, and the heel region 34. The ankle region 72 is primarily located in the heel region 34; however, in some embodiments, the ankle region 72 may partially extend into the midfoot region 32. Additionally, the ankle region 72 may extend upwardly from the foot region 70 and/or the sole structure 24 and terminate above the user's ankle 49 (e.g., a high-profile or high-top shoe 20), at the ankle 49 (e.g., a mid-profile shoe 20), or below the ankle 49 (e.g., a low-profile or low-top shoe 20). For example, the articles of footwear 20 shown in FIGS. 1 and 2-10 may be considered low-top shoes 20 as the ankle region 72 is sized to terminate below a user's ankle 49 (as shown in FIG. 9). Additionally, in some embodiments, the upper 22 may be coupled to a strobel board (not shown) that lies adjacent the sole structure 24.

Many conventional footwear uppers are formed from multiple elements, e.g., textiles, polymer foam, polymer sheets, leather, and/or synthetic leather, which are joined through bonding or stitching at a seam. In some embodiments, the upper 22 of the article of footwear 20 is formed from a knitted structure or knitted components. In various embodiments, a knitted component may incorporate various types of yarn that may provide different properties to an upper. For example, one area of the upper 22 may be formed from a first type of yarn that imparts a first set of properties, and another area of the upper 22 may be formed from a second type of yarn that imparts a second set of properties. Using this configuration, properties of the upper 22 may vary throughout the upper 22 by selecting specific yarns for different areas of the upper 22. Furthermore, in some embodiments, the properties associated with the upper 22, e.g., a stitch type, a weave type and/or direction, a yarn type, or characteristics associated with different stitch types, weave types, or yarn types, such as elasticity, aesthetic appearance, thickness, air permeability, or scuff-resistance, may be varied.

In some embodiments, the upper 22 may also include additional structural elements. For example, a heel counter (not shown) may be incorporated within the upper 22 at the heel region 34 to provide added support to a heel 48 of a user. For example, the heel counter can extend upward from the sole structure 24 adjacent the rear end 52 to substantially wrap around a user's heel 48. The heel counter can comprise one or more materials, such as plastic, that are substantially stiffer than the other material(s) that make up the upper 22 in order to support the heel 48. In some embodiments, the heel counter may be located internal to or embedded within the other material(s) of the upper 22, as is shown in FIGS. 1 and 3-9. In other embodiments, the heel counter may be located external from materials of the upper 22, such that it is visible outside the upper 22 adjacent the heel 48 or inside the upper 22 within the interior cavity 28 adjacent the heel 48, for example, coupled to the other material(s) of the upper 22. Furthermore, in some instances, other elements, e.g., plastic material, logos, trademarks, etc., may also be applied and fixed to an exterior surface of the upper 22 using glue or a thermoforming process.

In some embodiments, as shown in FIGS. 1, 3, 4, and 9, the upper 22 comprises a generally continuous or closed exterior surface 74 adapted to extend across the bridge 47 of a user's foot from the lateral side 62 to the medial side 64 (i.e., crossing the longitudinal axis 66). In this manner, the upper 22 provides a tongueless or sock-fit closure system with a slip-on construction, wherein the material(s) of the upper 22 are configured to hug tightly against the user's foot to help secure the article of footwear 20 to the user's foot 36. In such configurations, the upper 22 may include a corresponding gap 75 sized to permit entry and exit of the user's foot within the interior cavity 28. In other embodiments, the upper 22 can include an interrupted exterior surface 74, with an elongated central gap (not shown) between the lateral side 62 and the medial side 64 thereof at the bridge or instep of a user's foot. In such embodiments, the upper 22 can further include a tongue (not shown) that bridges the gap. In the closed or interrupted configurations, the upper 22 and its corresponding gap may be sized to permit insertion of the user's foot into the interior cavity 28. As further described below, the strap system 26 may allow the article of footwear 20 to tighten itself around the user's foot 36 and/or ankle 49 as the foot 36 is inserted into the interior cavity 28, regardless of the continuous or interrupted configuration of the upper 22.

Referring now to the sole structure 24, with reference to FIGS. 1, 4, 5, 9, and 10, the sole structure 24 is connected or secured to the upper 22 and extends between a foot 36 of a user and the ground when the article of footwear 20 is worn by the user. In some embodiments, the sole structure 24 may include an outsole 76 that provides structural integrity to the sole structure 24, along with providing traction for a user, a midsole (not shown) that provides a suspension and/or cushioning system, and the insole 68 (shown in FIGS. 5-7 and 10) that provides, for example, support for an arch 46 of a user. For example, the outsole 76 may be defined as a portion of the sole structure 24 that at least partially contacts an exterior surface, e.g., the ground, when the article of footwear 20 is worn. As such, in some applications, the outsole 76 may include specific structures configured to enhance traction, such as studs 77 (or other protrusions, spikes, cleats, or structures). The insole 68 may be defined as a portion of the sole structure 24 that at least partially contacts a user's foot 36 when the article of footwear 20 is worn. For example, in some embodiments, the insole 68 may be positioned on top of a strobel board (not shown). That is, the insole 68 can be a separate element that is inserted into the interior cavity 28 atop of the strobel board. Finally, the midsole may be defined as at least a portion of the sole structure 24 that extends between and connects the outsole 76 with the insole 68. Furthermore, the outsole 76, the midsole, and the insole 68, and/or any components thereof, may include portions within the forefoot region 30, the midfoot region 32, and/or the heel region 34. Further, the outsole 76, the midsole, and the insole 68, and/or any components thereof, may include portions on the lateral side 62 and/or the medial side 64. Additionally, in some embodiments, at the forefoot region 30, the outsole 76 may curve around the midsole (which may taper toward the front end 50) to extend upward and contact or nearly contact the upper 22.

Referring now to the strap system 26, according to some embodiments, generally, the interaction of a foot 36 during the insertion process into the article of footwear 20 causes the article of footwear 20 to tighten itself. More specifically, in some embodiments, the strap system 26 can include at least one strap configured to tighten portions of the upper 22 within the midfoot region 32 and the heel region 34 in response to the user's bodyweight pressing against the strap as the user's foot is inserted into the article of footwear 20. The at least one strap is therefore moveable within the interior cavity 28 as a result of the user's bodyweight pressing against the strap as the user's foot 36 is inserted into the interior cavity 28. That is, the strap moves from a first position suspended within the interior cavity 28, e.g., away from the insole 68, to a second position adjacent the insole 68 upon receiving the user's foot 36 within the interior cavity 28. The strap, and/or one or more additional straps or mechanisms, can further wrap around the user's foot 36, heel 48, and/or ankle 49 and tighten around the user's foot 36, heel 48, and/or ankle 49 as a result of the strap moving toward the second position, as further described below. As a result, once the user's foot 36 is inserted into the interior cavity 28 and the strap is in the second position, the article of footwear 20 can be secured to the user's foot 36 via the strap system 26. The article of footwear 20 can therefore self-tighten around the user's foot 36 through the application of bodyweight, providing more security than a sock-style shoe without the need for lacing, buckles, or other manual tightening systems.

More specifically, FIGS. 1 and 3-10 illustrate one example of the strap system 26 according to some embodiments. As shown in FIGS. 1 and 3-10, the strap system 26 interacts with the upper 22 and forms a stirrup region 78 (shown in FIGS. 5-8 and 10) and a tightening region 80.

Generally, in some embodiments, the stirrup region 78 can be located in the midfoot region 32, while the tightening region 80 can extend from the midfoot region 32 to the heel region 34. Both the stirrup region 78 and the tightening region 80 can extend across the lateral side 62 and the medial side 64. Furthermore, in some embodiments, the stirrup region 78 can generally extend into the interior cavity 28, while the tightening region 80 can generally extend out of the interior cavity 28, such as exterior to, or embedded within, material of the upper 22.

Referring still to FIGS. 1 and 3-10, in some embodiments, a first strap 82 forms both the stirrup region 78 and the tightening region 80 of the strap system 26. While the first strap 82 may comprise one, integral strap (e.g., the stirrup region 78 and the tightening region 80 are integrally coupled together), as shown in FIGS. 1 and 3-10, in some embodiments, the first strap 82 may comprise one or more separate straps coupled together. Furthermore, in some embodiments, the first strap 82 may form the stirrup region 78 and be coupled to one or more additional straps or other mechanisms, or portions of the upper 22, that form the tightening region 80. Thus, while the following discussion with reference to FIGS. 1 and 3-10 may refer to the first strap 82 in the singular, it should be understood that the discussion may apply to the first strap 82 as multiple straps coupled together or one or more straps and/or additional mechanisms without specifically noting such. Additionally, in some embodiments, the first strap 82 may incorporate one or more materials with sufficient flexibility that are capable of stretching, such as elastic materials.

Figure 5:
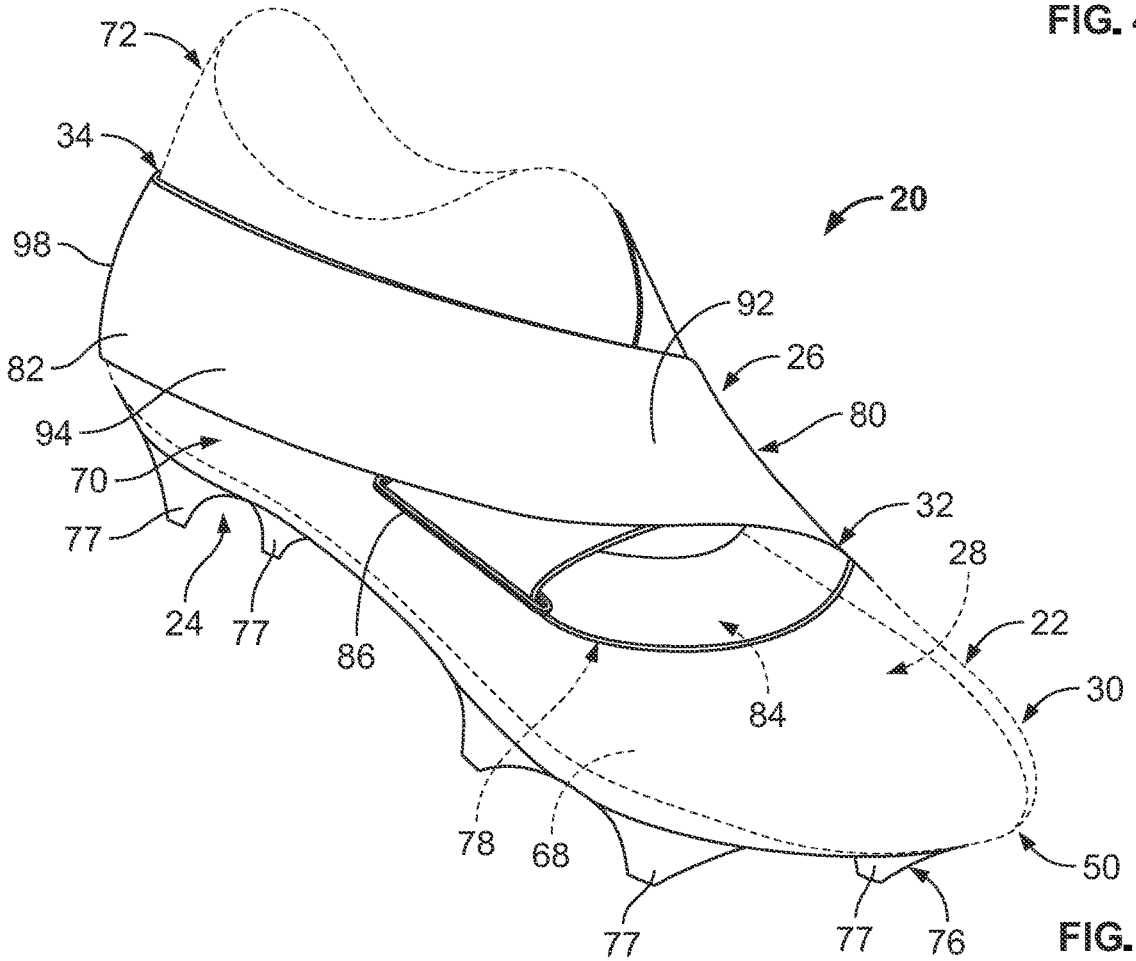
FIG. 5 is a lateral view of the left shoe of FIG. 1, with portions of an upper being transparent, in an "at rest" or "non-worn" state.
Figure 6:
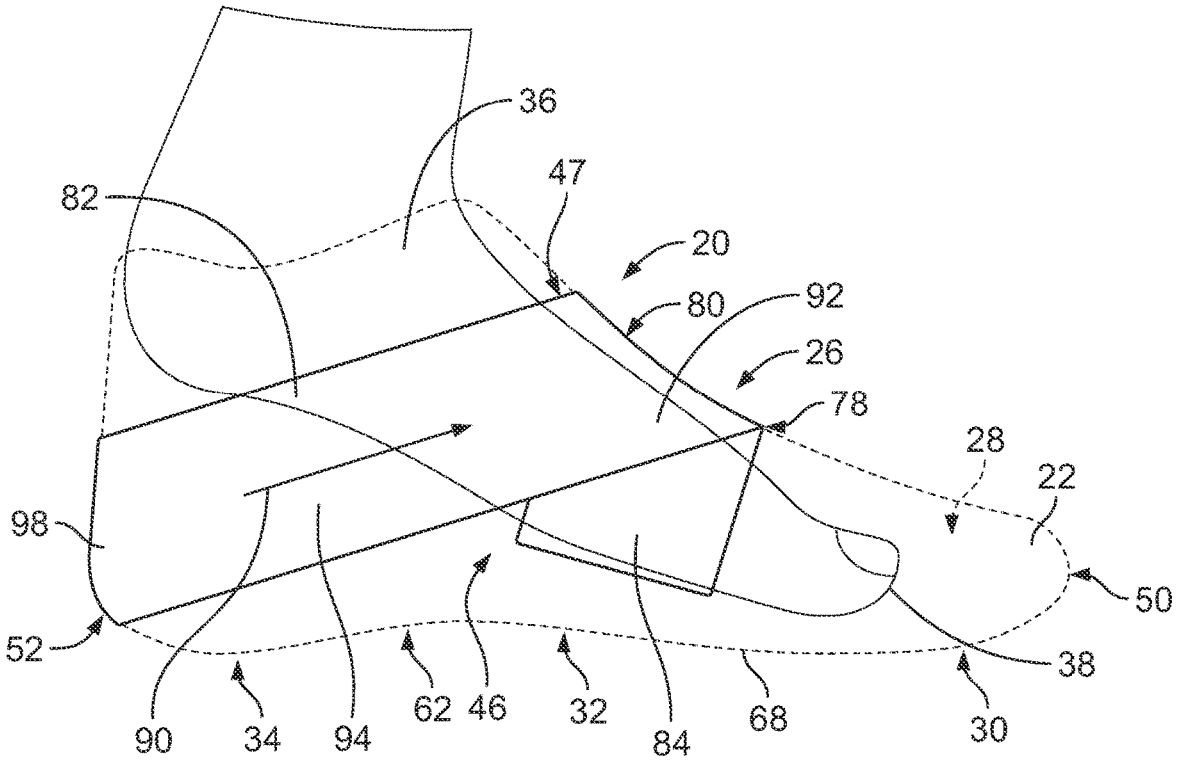
FIG. 6 is a side view of the left shoe of FIG. 1, with portions of an upper being transparent and portions of an outsole and midsole removed, as a user's foot is being inserted into an interior cavity thereof.
Figure 7:
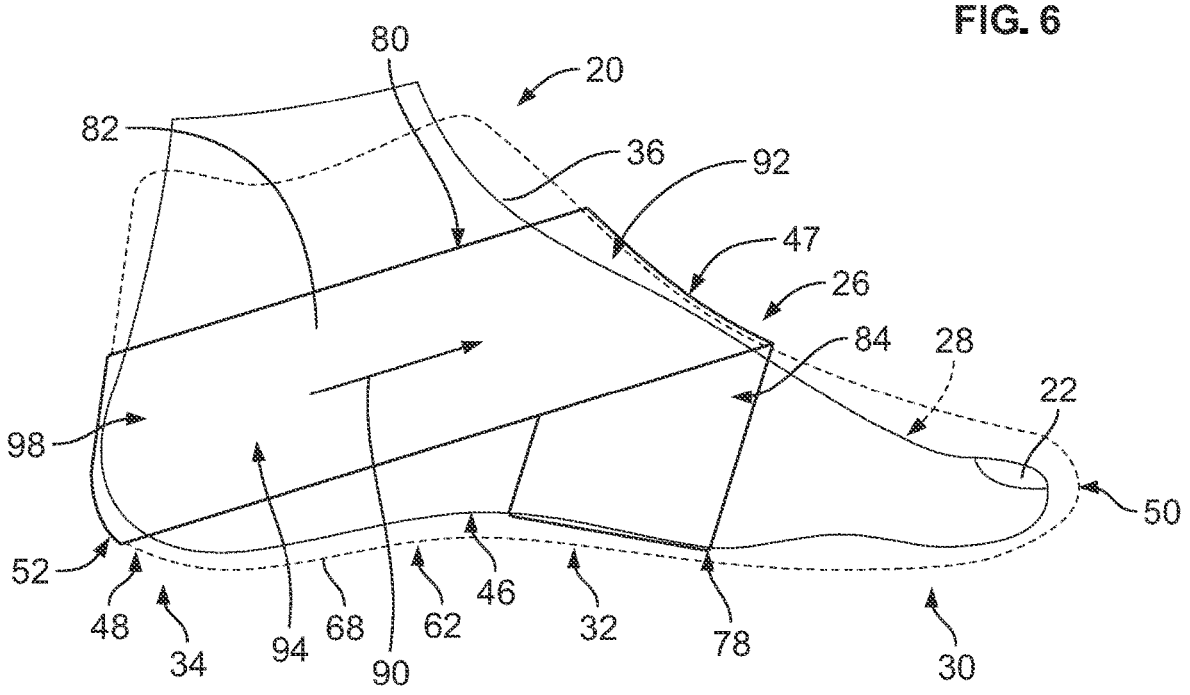
FIG. 7 is a side view of the left shoe of FIG. 1, with portions of an upper being transparent and portions of an outsole and midsole removed, as a user's foot is fully inserted into an interior cavity thereof.

Referring to FIGS. 5, 6, 7, and 10, the first strap 82 can extend downward into the interior cavity 28 from the upper 22 from the lateral side 62 to the medial side 64 to form a loop 84 suspended within the interior cavity 28, e.g., in the midfoot region 32. In such embodiments, this first portion of the first strap 82 comprising the loop 84 forms the stirrup region 78 of the strap system 26. The loop 84 is suspended within the interior cavity 28 and can receive a user's foot 36 as it is inserted into the article of footwear 20. For example, while at rest, the loop 84 may be located centrally within the interior cavity 28, or closer to the upper 22 than the sole structure 24. As further described below, a user's bodyweight can press the loop 84 toward the sole structure 24 as the foot is inserted into the article of footwear 20. That is, as the foot is inserted into the interior cavity 28, the foot engages or extends through the loop 84, like a stirrup, as shown in FIG. 6. As the foot is further pressed into the interior cavity 28, the user's bodyweight forces the loop 84 toward the sole structure 24, as shown in FIG. 7. For example, in some embodiments, when the user's foot is fully inserted into the interior cavity 28, the arch 46 of the user's foot 36 can engage the loop 84, as shown in FIG. 8, pressing it toward the sole structure 24. Thus, the loop 84 may be maintained within the midfoot region 32 to engage the user's arch 46. However, in some embodiments, the loop 84 may instead or additionally extend into the forefoot region 30. For example, the loop 84 may engage the arch 46 and/or the widest portion 54 of the user's foot and, thus, extend into both the midfoot region 32 and the forefoot region 30.

Referring to FIGS. 1, 3, 4, 5, and 9, the first strap 82 can extend out of the interior cavity 28 via a first aperture 86 of the upper 22 along the medial side 64 and via a second aperture 88 (shown in FIG. 3) of the upper 22 along the lateral side 62. From the first aperture 86 at the medial side 64, the first strap 82 can cross over the upper 22 to the lateral side 62, e.g., along the midfoot region 32 and crossing the central axis 66, and thereafter extend toward the rear end 52. In embodiments without a continuous upper 22, the first strap 82 can extend from the medial side 64 to the lateral side 62 across the gap over the tongue. Similarly, as shown in FIG. 3, from the second aperture 88 at the lateral side 62, the first strap 82 can cross over the upper 22 and over itself to the medial side 64, e.g., along the midfoot region 32 and crossing the central axis 66, and thereafter extend toward the rear end 52, looping around the rear end 52 back to the lateral side 62. While the first strap 82 is shown and described herein as crossing over itself in a first orientation, i.e., lateral-to-medial extension crossing over medial-to-lateral extension, some embodiments may incorporate crossovers in other orientations, e.g., medial-to-lateral extension crossing over lateral-to-medial extension. Additionally, while this portion of the first strap 82 extending out of the interior cavity 28 is shown in FIGS. 1, 3, 4, 5, and 9 to extend over the upper 22 as well, i.e., over the exterior surface 74 of the upper 22, in some embodiments, this portion of the first strap 82 may be fully exterior to the upper 22, may be interspersed through or embedded in between material(s) of the upper 22, and/or may be interlaced through the upper 22, e.g., extending into and out of the interior cavity 28 via additional apertures. In any such embodiments, the first strap 82 may engage the upper 22, but freely translate relative to the upper 22 in order to move into and out of the first aperture 86 and the second aperture 88 and across or through the upper 22 along the midfoot region 32 and around the heel region 34. For example, in some embodiments, the upper 22 can include exterior loops (not shown) coupled to the exterior surface 74 through which the first strap 82 may be routed.

This second portion of the first strap 82 described above that extends out of the interior cavity 28 can form the tightening region 80 of the strap system 26. More specifically, as discussed above, the stirrup region 78, or loop 84, presses toward the sole structure 24 as a user's foot 36 is inserted into the article of footwear 20, i.e., due to the user's bodyweight. As a result of the loop 84 being forced downward in the interior cavity 28, portions of the tightening region 80 are also pulled toward the interior cavity 28 through the first aperture 86 and the second aperture 88, e.g., as shown by arrows 90 in FIGS. 1, 4, 6, and 7. This causes the first strap 82 to tighten around the upper 22 along the heel region 34 and the midfoot region 32, as the first strap 82 loops around the heel region 34 and crisscrosses over the midfoot region 32, thus causing portions of the upper 22 within the heel region 34 and the midfoot region 32 to tighten around the user's foot 36.

Accordingly, in embodiments comprising the first strap 82, the stirrup region 78, formed by the loop 84, is situated within the interior cavity 28 along both the lateral side 62 and the medial side 64, crossing over the central axis 66, within the midfoot region 32 and/or the forefoot region 30, as shown in FIGS. 5, 6, 7, and 10. The tightening region 80 is generally situated outside of the interior cavity 28 along both the lateral side 62 and the medial side 64, generally above the stirrup region 78 within the midfoot region 32 (and/or the forefoot region 30) and again crossing over the central axis 66, as shown in FIGS. 1, 3, 4, 5, 9, and 10. Further, the tightening region 80 extends from the midfoot region 32 to the heel region 34 and, in some embodiments, extends around the heel region 34. Along the heel region 34 and/or the midfoot region 32, the tightening region 80 may be routed through the foot region 70 and/or may extend into the ankle region 72. More specifically, in some embodiments, as shown in FIGS. 1 and 3-10, the tightening region 80 can include a crossing portion 92, a lateral portion 94, a medial portion 96, and a heel portion 98. The crossing portion 92 can be located within the midfoot region 32 (and/or the forefoot region 30), generally above the stirrup region 78 where the first strap 82 crosses over itself. The heel portion 98 can be located in the heel region 34 where the first strap 82 extends around the heel region 34. The lateral portion 94 can extend across the lateral side 62 from the crossing portion 92 to the heel portion 98, and the medial portion 96 can extend across the medial side 64 from the crossing portion 92 to the heel portion 98.

Figure 10:
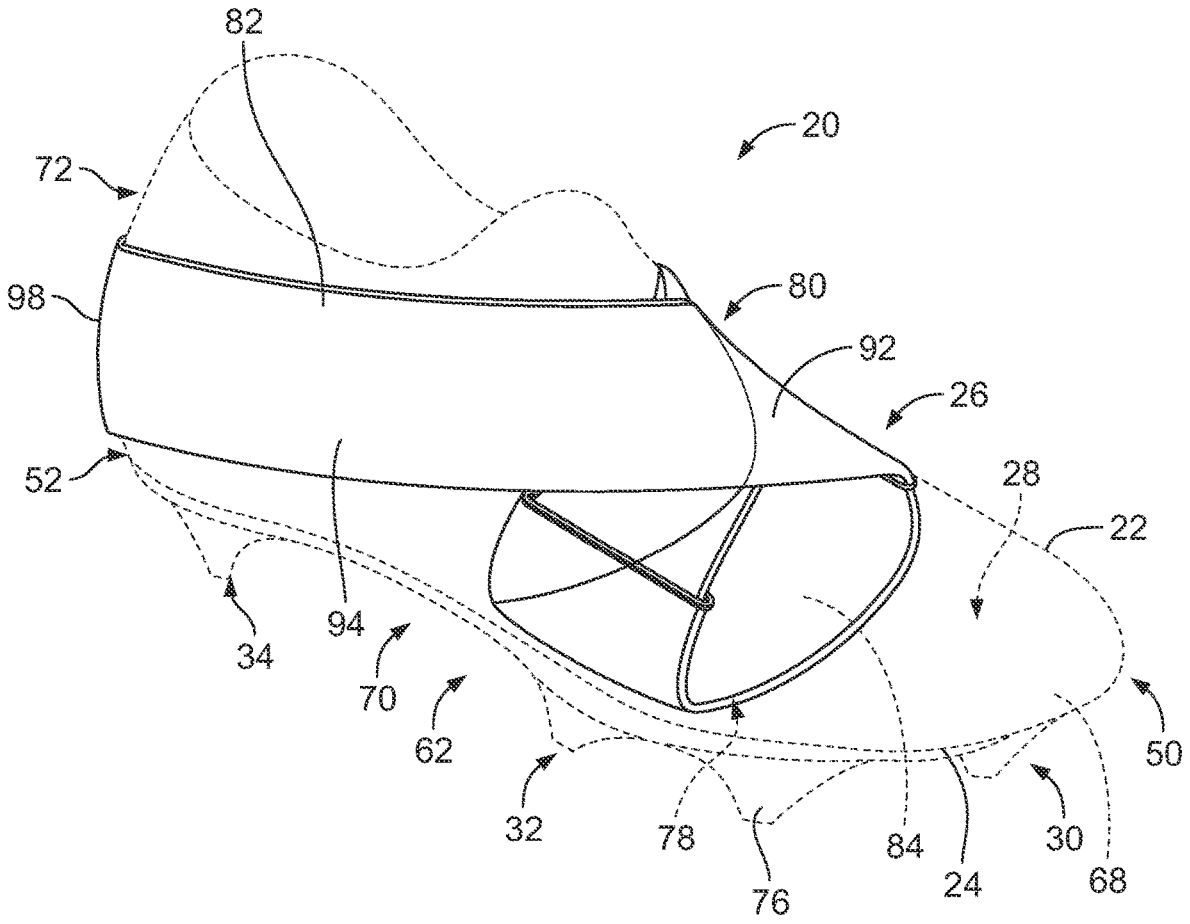
FIG. 10 is a lateral view of the left shoe of FIG. 1, with portions of an upper being transparent, in an "engaged" or "worn" state.

By way of example, FIG. 5 illustrates the strap system 26 in an "at rest" or "non-worn" state without a foot 36 inserted. As shown in FIG. 5, the stirrup region 78 (e.g., the loop 84) is suspended within the interior cavity 28. Furthermore, the tightening region 80 can be fully outside of the interior cavity 28, and loose enough around the heel region 34 and midfoot region 32 to permit foot insertion into the interior cavity 28. FIG. 10 illustrates the strap system 26 in a "worn" or "engaged" state with a foot inserted (not shown). As shown in FIG. 10, generally, the stirrup region 78 is pressed toward or against the sole structure 24 and also is pressed outward toward or against an interior surface of the upper 22 within the midfoot region 32, as a result of the user's foot 36 engaging the loop 84. Thus, in the worn state, the stirrup region 78 can contact portions of the sole structure 24 and the upper 22 that the user's foot 36, e.g., around the arch 46, would normally contact when inserted into the interior cavity 28. Movement of the stirrup region 78 causes the tightening region 80 to tighten around the user's heel 48 and bridge 47. More specifically, as a result of the tightening region 80 extending over or interspersed through the upper 22 in the heel region 34 and the midfoot region 32, the tightening region 80 causes portions of the upper 22 to tighten around the user's heel 48 and bridge 47 upon foot insertion, securing the user's foot 36 within the article of footwear 20. Additionally, in the "engaged" state, some of the tightening region 80 may extend into the interior cavity 28. It should be noted that reference herein to the strap system 26 causing portions of the upper 22 to tighten around the user's foot 36 may be a general reference to tightening around any portion of the user's foot 36, bridge 47, heel 48, and/or ankle 49.

In light of the above, some embodiments provide a strap system 26 that can self-tighten around a user's foot upon insertion into the interior cavity 28 of the article of footwear 20. More specifically, upon insertion of the foot into the interior cavity 28, the foot (e.g., the arch 46 and the bridge 47) interacts with the stirrup region 78 and the user's bodyweight causes the stirrup region 78 to press toward the sole structure 24. When bodyweight is applied to the stirrup region 78, the tightening region 80 is automatically pulled toward the interior cavity 28, causing the upper 22 to tighten around the heel 48 and/or bridge 47 of the foot 36, thereby securing the foot within the article of footwear 20.

In the embodiments shown and described above, the self-tightening is accomplished via a strap system 26 with a single strap 82 that loops within the interior cavity 28 and extends out of the interior cavity 28 to cross over the user's bridge 47 and loop around the user's heel 48. As a result, tightening of the upper 22 around the user's foot 36 is accomplished by the strap system 26 at both the midfoot region 32 (e.g., along the bridge 47) and the heel region 34 (e.g., around the heel 48). More specifically, the strap system 26 pulls the upper 22 against the user's bridge 47 and heel 48 to secure the user's foot 36 within the article of footwear 20.

In some embodiments, the strap system 26 may incorporate additional or other structures to accomplish self-tightening. For example, in some embodiments, the strap 82 may not extend completely around the heel 48, e.g., may not include a heel portion 98. Rather, the strap 82 may be coupled to the upper 22 at the heel region 34 along the lateral side 62 and the medial side 64. That is, the lateral portion 94 can be coupled to the heel region 34 along the lateral side 62 and the medial portion 96 can be coupled to the heel region 34 at the medial side 64. When the strap 82 is tightened, it pulls the heel region 34 of the upper 22 at the coupling locations, causing the upper 22 to pull toward the user's heel 48 to secure the foot 36 within the article of footwear. Thus, whether the strap 82 completely loops around the heel region 34 or is only coupled to portions of the upper 22 at the heel region 34, tightening is still accomplished by the strap system 26 at the heel region 34. Furthermore, while the strap system 26 and, more specifically, the tightening region 80, illustrated herein is configured to loop around the heel region 34 generally adjacent a user's heel 48, the tightening region 80 may be additionally or alternatively configured to loop around the heel region 34 within the ankle region 72, generally adjacent the user's ankle 49.

Additionally, while the first strap 82 is illustrated in FIGS. 1 and 3-10 as having a uniform width through the stirrup region 78 and the tightening region 80, in some embodiments, the first strap 82 may have a non-uniform width. For example, in some embodiments, a width of the first strap 82 may be smaller along the lateral portion 94 and the medial portion 96 than the crossing portion 92, the heel portion 98, and/or the loop 84. In some embodiments, the width of the first strap 82 may be non-uniform within the loop 84 itself. For example, in some embodiments, the loop 84 can have a larger width along the medial side 64 to provide better arch support. In yet other embodiments, the first strap 82 may have a non-uniform width within any one of the crossing portion 92, the lateral portion 94, the medial portion 96, the heel portion 98, and/or the loop 84.

Figure 11:
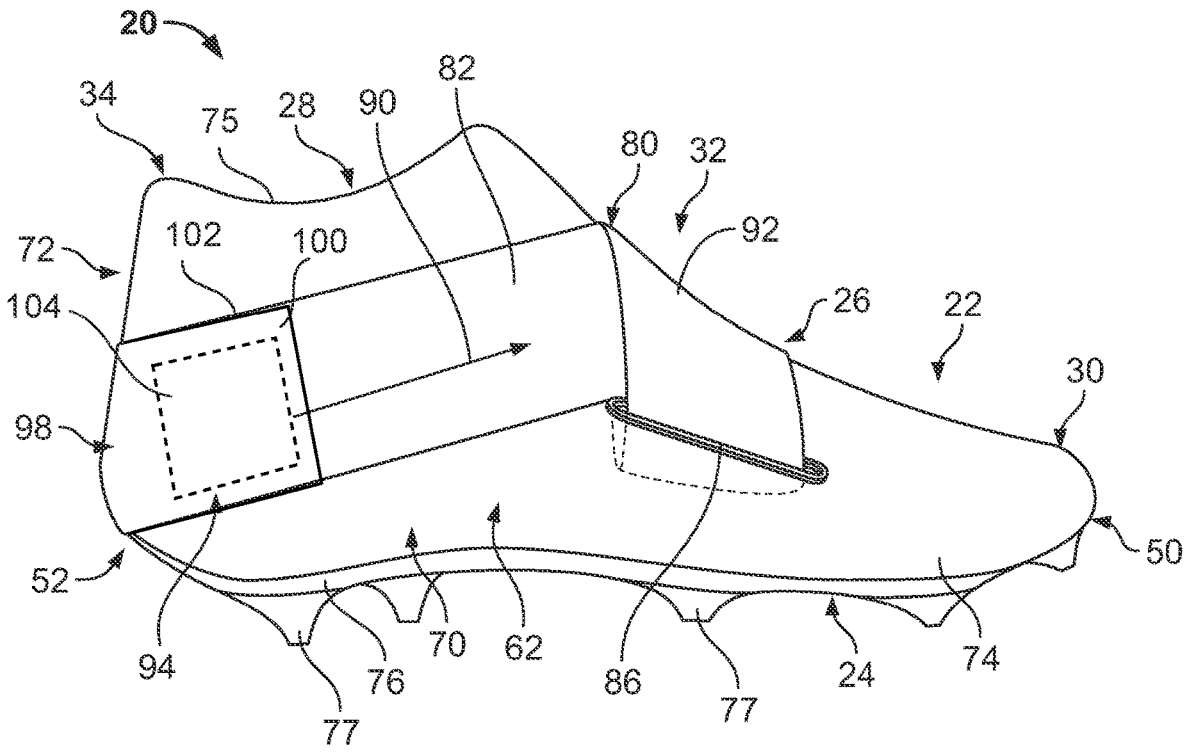
FIG. 11 is a side view of a right shoe comprising a releasable strap system.

Furthermore, while the first strap 82 is illustrated in FIGS. 1 and 3-10 as having a continuous length, in some embodiments, the first strap 82 can include a non-continuous and/or adjustable length. For example, FIG. 11 illustrates an article of footwear 20 including a releasable first strap 82. As shown in FIG. 11, the first strap 82 can include two separate ends 100, 102 that are coupled together. As a result, the first strap 82 can be "released" by decoupling or separating the two ends 100, 102 from each other. When in the non-worn state, releasing the first strap 82 can cause the stirrup region 78 (e.g., the loop 84) to no longer be suspended within the interior cavity 28 but, rather, rest in a relaxed state toward or against the sole structure 24. Furthermore, the tightening region 80 can remain loose enough around the heel region 34 and midfoot region 32 to permit foot insertion into the interior cavity 28. Accordingly, releasing the first strap 82 can provide a smoother instep and easier foot insertion through the loop 84. It should be noted, however, that the first strap 82 having two ends 100, 102 coupled together can operate in the same manner as the constant-length first strap 82 described above with respect to FIGS. 1 and 3-10. That is, in embodiments having a first strap 82 with two separate ends 100, 102, a user may still insert the foot when the two ends 100, 102 are coupled together, e.g., when the loop 84 is suspended in the interior cavity 28.

Referring still to the releasable strap configuration of FIG. 11, when in the worn state, that is, after a foot 36 has been inserted into the article of footwear 20, a user can again couple the two ends 100, 102 of the first strap 82 together in order to tighten the first strap 82 around the foot in response to the user's bodyweight pressing against the loop 84, as described above. Furthermore, in some embodiments, the two ends 100, 102 can be coupled together at more than one location, thus permitting a length of the first strap 82 to be adjusted. As a result, an overall tightness of the first strap 82 when in the worn state can be adjusted (e.g., the first strap 82 is pulled tighter around the foot, for example, for a more secure fit). Accordingly, providing an adjustable tightness can be beneficial to accommodate different foot widths and volumes. For a user to move from the worn state to the at rest state, the user may pull their foot 36 out of the interior cavity 28 while the ends 100, 102 of the first strap 82 remain coupled together. Alternatively, the user may first release the ends 100, 102 of the first strap 82 in order to loosen the first strap 82, and then pull their foot 36 out of the interior cavity 28.

Referring still to FIG. 11, the releasable first strap 82 includes a first end 100 and a second end 102 coupled to the first end 100 via fastening elements 104, such as mating hook and loop fasteners. In some embodiments, the fastening elements 104 can be variable fastening elements, e.g., allowing different coupling locations to provide an adjustable first strap length. Variable fastening elements can include, but are not limited to, hook and loop fasteners (as shown in FIG. 11), and multiple sets of buttons, snaps, or clips positioned along a length of one or both of the ends 100, 102. However, in other embodiments, the fastening elements 104 can be discrete fastening elements, e.g., allowing a single coupling location such that the adjustable first strap 82 may either be in a released state or a coupled state with a single, set first strap length. Discrete fastening elements can include, but are not limited to, a single button, snap, or clip on each end 100, 102. Additionally, in some embodiments, the two ends 100, 102 can be coupled together adjacent the crossing portion 92, the lateral portion 94 (as shown in FIG. 11), the medial portion 96, or the heel portion 98. As the first strap 82 may be freely moveable through the upper 22 and/or the apertures 86, 88 in some embodiments, this coupling location may vary based on user preference.

In light of the above, the strap system 26 can secure a user's foot 36 within an article of footwear 20 without the need for traditional lacing or buckling systems. This provides enhanced ease-of-use for individuals with impaired dexterity or ability to reach their feet, in that the article of footwear 20 is self-tightening and a user need not reach down to tie laces or buckle buckles. Furthermore, in some embodiments, the strap system 26 can provide a smooth upper 22 across the entire top of the foot 36 (e.g., as opposed to lacing systems which would interrupt a smooth upper 22). This can be beneficial for sports such as soccer, providing a larger smooth surface area for improved contact with a ball.

Additionally, the strap system 26 need not require locking mechanisms, as the construction of the strap system 26, e.g., tightening across the bridge 47 and around the heel 48, maintains the self-tightening function in response to the user's bodyweight. However, in some embodiments, the strap system 26 can include additional locks, buckles, or other mechanisms configured to further tighten and/or maintain the tightening region 80 in place, such as, but not limited to, the example illustrated in FIG. 11. As another example, in some embodiments, the strap system 26 can include a tightening mechanism (not shown), e.g., engaging the first strap 82 at the midfoot region 32 where the first strap 82 crosses over itself, or at the heel region 34. If a user desires further tightening after the foot 36 is inserted, the user can engage or twist the tightening mechanism, causing the tightening mechanism to further pull the strap 82 in the direction of arrows 90, thus further tightening the tightening region 80.

Turning now to FIGS. 12-15B, an article of footwear 20 having toe-engagement configurations may include similar components and features as described above with respect to the article of footwear 20 of FIGS. 1-11. Thus, in FIGS. 12-15B, like numerals illustrate like components as described above with respect to the article of footwear 20 of FIGS. 1-11. And, while any of the above-described features of the like components of the bodyweight configurations of FIGS. 1-11 can be incorporated into the toe-engagement configurations of FIGS. 12-15B in some embodiments, such features may not be described in detail again below for the sake of brevity.

Figure 12:
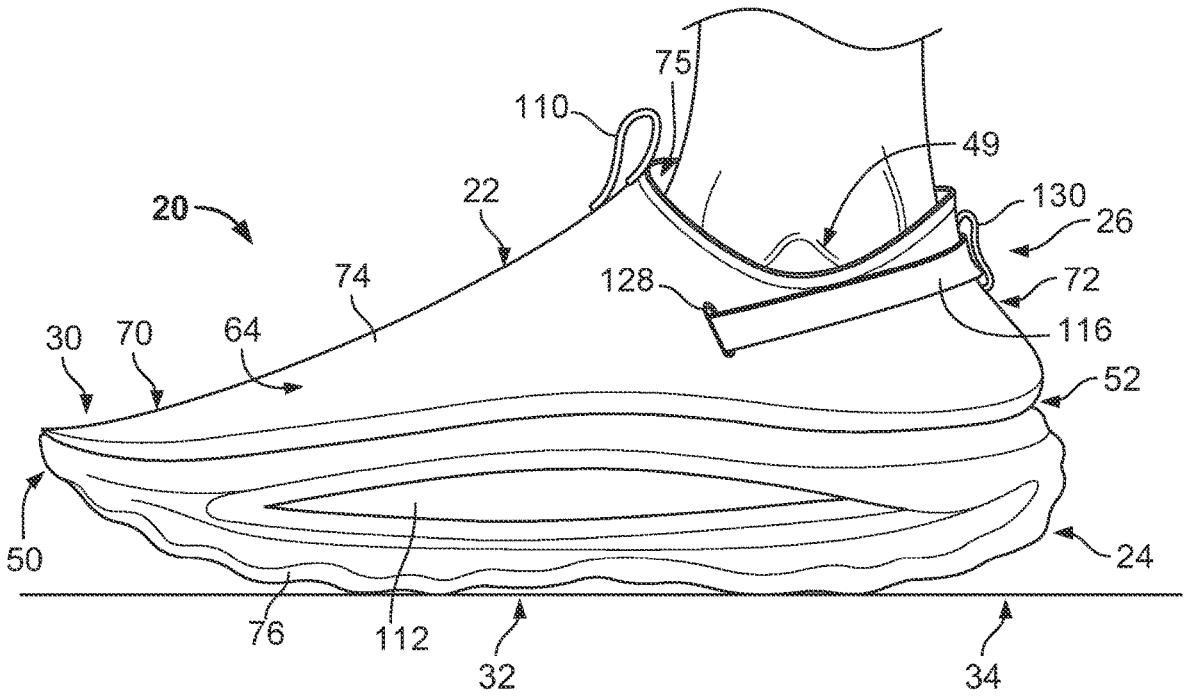
FIG. 12 is a lateral view of a right shoe comprising a strap system, according to another configuration, in a "locked" or "tightened" state.

Accordingly, FIG. 12 depicts the article of footwear 20, configured as a right shoe, with an upper 22, a sole structure 24, and a strap system 26 engaged with the upper 22. The upper 22 is attached to the sole structure 24 such that the components define an interior cavity 28 (shown in FIG. 13) into which a foot 36 of a user may be inserted. The strap system 26 includes a rail accessible within the interior cavity 28 and one or more straps configured to extend from the rail around portions of the upper 22. Furthermore, FIG. 13 further depicts the article of footwear 20 and FIGS. 14A-15B depict the strap system 26, in part or in whole, in various configurations. The article of footwear 20 may also include additional components not specifically addressed herein.

As discussed in greater detail below, the article of footwear 20 of FIGS. 12-15B and, in particular, the strap system 26, is intended to actively tighten or loosen the upper 22 around a user's foot in response to the user engaging the strap system 26. More specifically, when the user's foot 36 is inserted into the article of footwear 20, the user's toes can engage a rail of the strap system 26. The user can push their toes against the rail to "lock" the strap system 26, causing portions of the strap system 26 to tighten the upper 22 around the user's foot, heel, and/or ankle, and the user can retract their toes away from the rail to "unlock" the strap system 26, causing portions of the strap system 26 to loosen the upper 22 around the user's foot, heel, and/or ankle. These and other features will be described in greater detail below.

Though the article of footwear 20 is depicted in FIG. 12 as a single, right shoe 20, the article of footwear 20 may be part of a pair of articles of footwear 20 (e.g., a footwear assembly) comprising a first or right shoe (shown in FIGS. 12 and 13) and a second or left shoe (not shown). The right shoe and the left shoe may be similar in all material aspects, except that the right shoe and the left shoe are sized and shaped to receive a right foot and a left foot of a user, respectively. Thus, for ease of disclosure, a single shoe, or article of footwear 20, will be referenced below to describe aspects of the disclosure. More specifically, the disclosure herein with reference to the article of footwear 20 is applicable to both the right shoe and the left shoe, though the article of footwear 20 is depicted as a right shoe in the present figures. In some embodiments, there may be differences between the right shoe and the left shoe other than the right/left configuration, or the right shoe may include one or more additional elements that the left shoe does not include, or vice versa.

With reference now to the upper 22 and FIGS. 12 and 13, as discussed above, an ankle region 72 may extend upwardly from a foot region 70 and/or a sole structure 24 and terminate above a user's ankle 49 (e.g., a high-profile or high-top shoe 20), at the ankle 49 (e.g., a mid-profile shoe 20), or below the ankle 49 (e.g., a low-profile or low-top shoe 20). Here, the article of footwear 20 shown in FIGS. 12 and 13 may be considered a mid-profile shoe 20 as the ankle region 72 is sized to terminate at a user's ankle 49 (as shown in FIG. 12).

Figure 13:
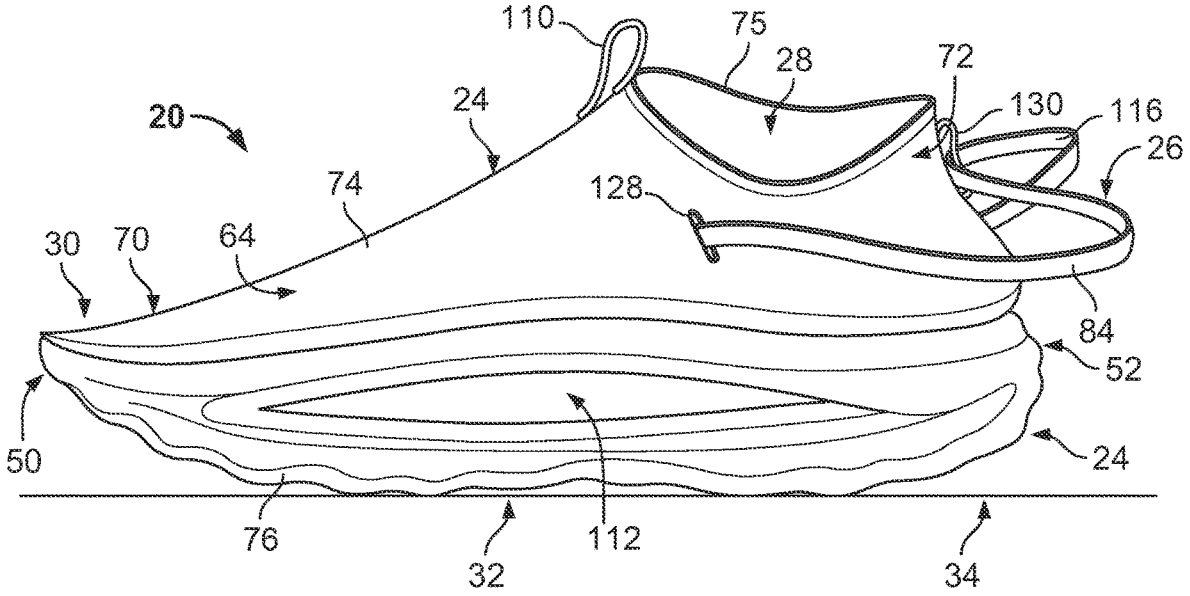
FIG. 13 is a lateral view of the right shoe of FIG. 12 in an "unlocked" or "loosened" state.

In some embodiments, as shown in FIGS. 12 and 13, the upper 22 provides a tongueless or sock-fit closure system with a slip-on construction, wherein the material(s) of the upper 22 are configured to hug tightly against the user's foot 36 to help secure the article of footwear 20 to the user's foot 36. In some embodiments, a loop 110 can be coupled to a top of the upper 22, for example, to assist a user to pull the upper 22 onto the foot 36. While FIGS. 12 and 13 illustrate the loop 110 adjacent a top of the upper 22, e.g., in front of the ankle 49 adjacent the bridge 47, some embodiments may additionally or alternatively include the loop 110 along other locations of the upper 22, such as adjacent a rear of the upper 22 at the rear end 52, e.g., behind the ankle 49. Also, in some embodiments, the upper 22 can include an interrupted exterior surface 74, with an elongated central gap (not shown) between the lateral side 62 and the medial side 64 thereof at the bridge 47 or instep of a user's foot 36. In such embodiments, the upper 22 can further include a tongue (not shown) that bridges the gap and a tightening mechanism (such as laces, straps, buckles, etc.) configured to tighten the medial and lateral sides of the upper 22 over the tongue, allowing the user to adjust shoe tightness. Furthermore, as further described below, the strap system 26 may allow the article of footwear 20 to tighten itself around the user's foot 36 and/or ankle 49, regardless of the continuous or interrupted configuration of the upper 22.

Referring now to the sole structure 24, with reference to FIGS. 12 and 13, in some embodiments, the sole structure 24 may include an outsole 76 that provides structural integrity to the sole structure 24, along with providing traction for a user, a midsole 112 that provides a suspension and/or cushioning system, and the insole 68 (shown in FIG. 2) that provides, for example, support for an arch 46 of a user, as described above with respect to the article of footwear of FIGS. 1-11.

Referring now to the strap system 26, according to some embodiments, generally, the interaction of at least one toe 38 with the strap system 26 causes the article of footwear 20 to tighten or loosen itself. More specifically, in some embodiments, the strap system 26 can include a rail and at least one strap engaged with the rail and configured to tighten the upper 22 around the user's foot 36. The at least one strap is moveable as a result of the user's toe(s) pressing or pulling the rail inside the interior cavity 28. That is, the strap moves from a first position when the user's toes press the rail outward toward the front end 50 of the article of footwear 20, thus tightening the article of footwear 20, to a second position when the user's toes bend to pull the rail inward toward the rear end 52, thus loosening the article of footwear 20. The strap, and/or one or more additional straps or mechanisms, can wrap around the user's foot 36, heel 48, and/or ankle 49 and tighten around the user's foot 36, heel 48, and/or ankle 49 as a result of the strap moving toward the first position, as further described below. The article of footwear 20 can therefore self-tighten around the user's foot 36 through toe movement, providing more security than a sock-style shoe without the need for lacing, buckles, or other manual tightening systems.

Figure 14B:
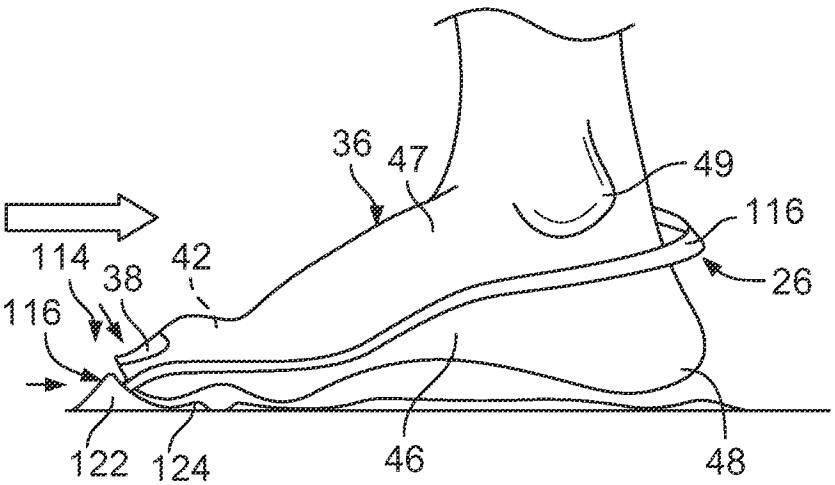
FIG. 14B is lateral view of a user's foot relative to the strap system of the shoe of FIG. 12 when in the at rest state in response to the user's toe movement.
Figure 14A:
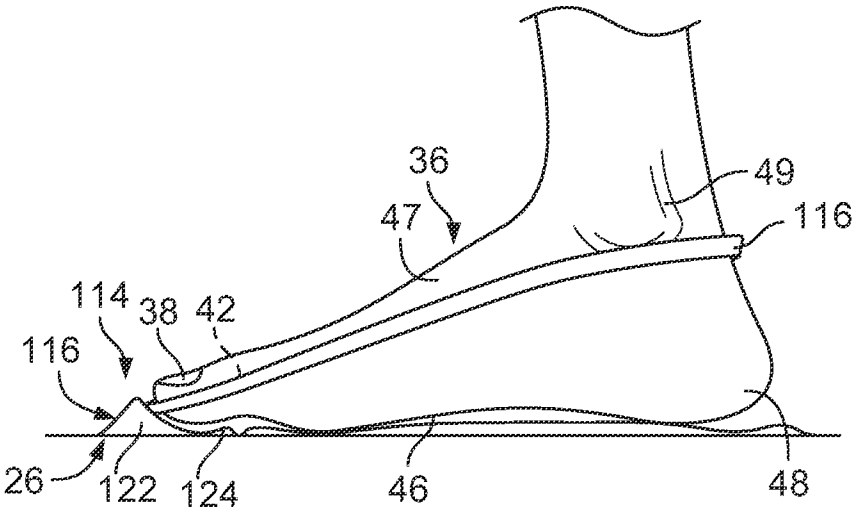
FIG. 14A is lateral view of a user's foot relative to the strap system of the shoe of FIG. 12 when in the engaged state.
Figure 15B:
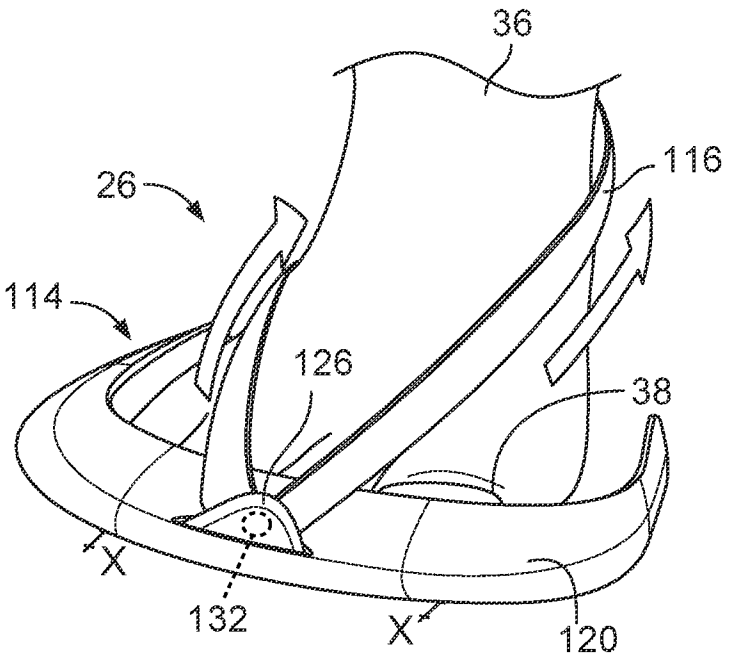
FIG. 15B is a front perspective view of a user's foot relative to the strap system of the shoe of FIG. 12 when in the engaged state in response to the user's toe movement.

More specifically, FIGS. 12, 13, and 14A-15B illustrate one example of the strap system 26 according to some embodiments. The strap system 26 includes a rail 114 (shown in FIGS. 14A-15B) and at least one strap 116 (shown in FIGS. 12, 13, and 14A-15B). Generally, the rail 114 can be positioned within the forefoot region 30 such that a user's toes 38 can interact with the rail 114, as shown in FIGS. 15A and 15B. For example, the rail 114 can be positioned in the forefoot region 30 within the interior cavity 28, such as along a forward-most edge of the interior cavity 28 at the front end 50. The rail 114 can extend from the front end 50 around the medial side 64 and the lateral side 62 toward the midfoot region 32 (such as to the first line 56 shown in FIG. 2). However, in some embodiments, the rail 114 can extend into the midfoot region 32. The at least one strap 116 can engage the rail 114 (as shown in FIGS. 14A-15B) and can extend from the forefoot region 30, across the midfoot region 32, to the heel region 34 (as shown in FIGS. 12, 13 and 14A-15B). The at least one strap 116 can extend across the lateral side 62 and the medial side 64, and can generally extend into the interior cavity 28 to engage the rail 114 as well as out of the interior cavity 28, such as exterior to, or embedded within, material of the upper 22.

Figure 15A:
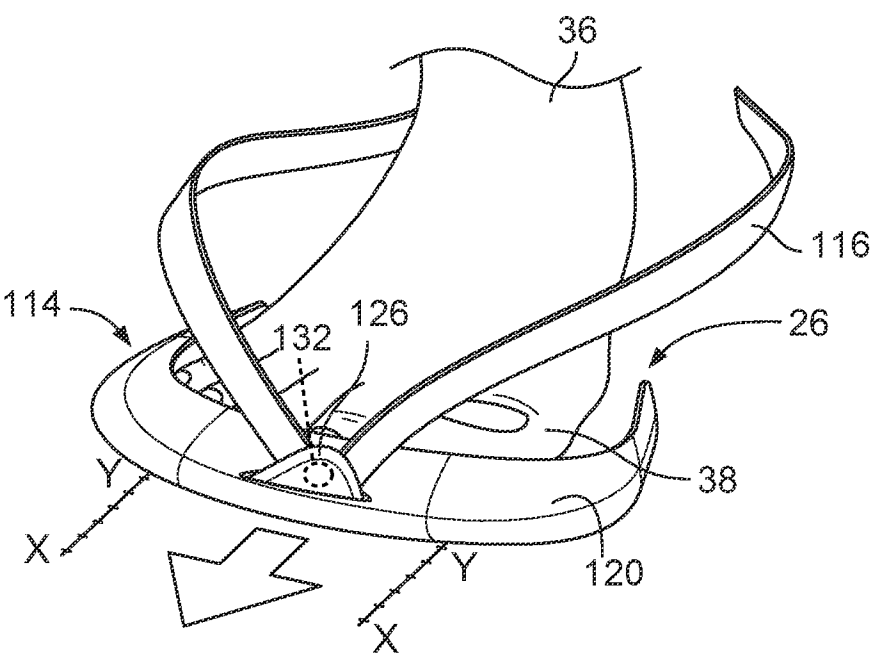
FIG. 15A is a front perspective view of a user's foot relative to the strap system of the shoe of FIG. 12 when in the at rest state.

With further reference to the rail 114, as shown in FIGS. 14A-15B, the rail 114 can include a base portion 118 (shown in FIGS. 14A and 14B) and a cover portion 120 (shown in FIGS. 15A and 15B). In some embodiments, the base portion 118 and the cover portion 120 can be made of plastic. However, other materials may be used in different embodiments. Furthermore, in some embodiments, the base portion 118 and the cover portion 120 can be integral pieces. However, in other embodiments, the base portion 118 and the cover portion 120 can be separate pieces coupled together. In some embodiments, the base portion 118 and/or the cover portion 120 can be permanently fixed within the article of footwear 20 or removable from the article of footwear 20. For example, in one embodiment, the cover portion 120 can be fixed within the article of footwear 20 (e.g., integrated with the upper 22) and the base portion 118 can be removable from the article of footwear 20, capable of being interlocked with the cover portion 120 when inserted into the article of footwear 20.

Referring still to FIGS. 14A-15B, generally, the base portion 118 can be positioned on the insole 68 and moveable within the interior cavity 28. In some embodiments, the base portion 118 can be separate from the insole 68. In other embodiments, the base portion 118 can be coupled to the insole 68. In yet other embodiments, the base portion 118 can be an integral part of the insole 68. For example, referring to FIG. 2, some or all of the forefoot region 30 of the insole 68 may comprise the base portion 118. Additionally, in some embodiments, the base portion 118 can be freely moveable within the interior cavity 28, or moveable along a set distance. For example, as shown in FIGS. 15A and 15B, the base portion 118 can be movable within the interior cavity 28 between a first position X and a second position Y (wherein the difference between X and Y equals the set length). The first position X may indicate a "locked" or "tightened" position while the second position Y may indicate an "unlocked" or "loosened" position, as further described below.

As shown in FIGS. 14A and 14B, the base portion 118 can include a front portion 122 configured to engage or contact a distal portion of a user's toes 38 when the user's foot 36 is within the interior cavity 28. As such, the front portion 122 can extend up from the insole 68, such as along a curved or straight incline. For example, one or more of the user's toes 38 can engage the front portion 122 to push the base portion 118 forward, i.e., toward the front end 50, toward the first position X. In some embodiments, the base portion 118 can also include an inner bump 124 configured to engage an underside of the user's toes 38, e.g., below the joints 42, thus allowing the user to grasp the base portion 118 when folding or curling their toes 38, as shown in FIG. 14B. For example, one or more of the user's toes 38 can engage the inner bump 124 to pull the base portion 118 backward, i.e., toward the rear end 52, toward the second position Y.

In some embodiments, the base portion 118, or a portion thereof, can be movable between the first position X and the second position Y by freely sliding across the insole 68. Additionally, in some embodiments, the base portion 118 can be moveable between the first position X and the second position Y by sliding across a track (not shown). For example, the track can include notches near the first position X and the second position Y to hold the base portion 118 at either position, requiring the user to apply sufficient force to overcome this hold in order to move the base portion 118 along the track between the positions. Additionally, in some embodiments, the track can include further notches between the first position X and the second position Y to permit gradual adjustments, as further discussed below.

Referring to FIGS. 15A and 15B, the cover portion 120 can be arranged adjacent a distal end of the base portion 118 and at the front end 50 of the article of footwear 20. In some embodiments, the cover portion 120 can be coupled to the base portion 118. However, in other embodiments, the cover portion 120 may remain stationary at the front end 50 while the base portion 118 slides between the first position X and the second position Y. Furthermore, the cover portion 120 can be shaped to generally follow a shape of the upper 22 at the front end 50 and extend over a portion of the user's toes 38, as shown in FIG. 15B. The cover portion 120 can also extend around the front end 50 along the lateral side 62 and the medial side 64 within the forefoot region 30. However, in some embodiments, the cover portion 120 may extend into the midfoot region 32.

Referring still to FIGS. 15A and 15B, the cover portion 120 can include a strap engagement 126 configured to receive the strap 116. Alternatively, in some embodiments, the strap engagement 126 may be part of the base portion 118. In some embodiments, the strap 116 can be routed into the cover portion 120 (or the base portion 118) via the strap engagement 126. For example, the strap engagement 126 can include one or more internal mechanisms configured to pull the strap 116 into the cover portion 120 (or the base portion 118) in order to tighten the strap 116 around the upper 22, as shown in FIG. 15B, and to release the strap 116 out of the cover portion 120 (or the base portion 118) in order to loosen the strap 116 around the upper 22, as shown in FIG. 15A. As such, the strap 116 is configured to tighten portions of the upper 22 based on a location of the base portion, e.g., along the set distance between and including the first position X and the second position Y.

By way of example, in some embodiments, the strap engagement 126 can include an internal mechanism such as a rotating buckle 132, configured to rotate in response to movement of the base portion 118. That is, when the base portion 118 is moved toward the first position X, the movement causes the rotating buckle 132 to rotate in a first direction that winds the strap 116 into the buckle 132, thus pulling the strap 116 into the cover portion 120 and tightening the strap 116 around the upper 22. When the base portion 118 is moved toward the second position Y, the movement causes the rotating buckle 132 to rotate in a second direction that unwinds the strap 116 and releases the strap 116 out from the cover portion 120, thus loosening the strap 116. Other internal mechanisms or features may be contemplated in some embodiments that pull the strap 116 when the base portion 118 is moved toward the first position X, and release the strap 116 when the base portion 118 is moved toward the second position Y.

Alternatively, in some embodiments, the strap engagement 126 may only hold the strap 116. That is, the strap 116 is coupled to the strap engagement 126 and not moveable within or relative to the strap engagement 126. In such embodiments, the cover portion 120 can be coupled to and moveable with the base portion 118. As a result, in such embodiments, tightening is caused by moving the cover portion 120, and the strap 116, toward the front end 50 of the article of footwear 20, i.e., pulling the strap 116 toward the front end 50, and loosening is caused by moving the cover portion 120, and the strap 116, away from the front end 50.

Referring now to the strap 116, as shown in FIGS. 14A and 14B, the strap 116 can extend from the strap engagement 126 adjacent the front end 50 to the rear end 52 to extend around the user's heel 48. That is, the strap 116 can extend from the strap engagement 126, around the lateral side 62, to the rear end 52, loop around the rear end 52, around the medial side 64, and back to the strap engagement 126. While the strap 116 may comprise one, integral strap, as shown in FIGS. 12, 13, and 14A-15B, in some embodiments, the strap 116 may comprise one or more separate straps coupled together. As such, while the present discussion with reference to FIGS. 12, 13, and 14A-15B may refer to the strap 116 in the singular, it should be understood that the discussion may apply to the strap 116 as multiple straps coupled together or one or more straps and/or additional mechanisms without specifically noting such. Additionally, in some embodiments, the strap 116 may have a uniform width across its entire length, or have varying widths, and can incorporate one or more materials with sufficient flexibility that are capable of stretching, such as elastic materials. In some embodiments, the strap 116 may comprise thermoplastic polyurethane (TPU) foil. Furthermore, in some embodiments, the strap 116 may be adhered or otherwise coupled to the upper 22 at one or more locations along the upper 22.

As discussed above, the strap 116 can extend into the interior cavity 28, such as at the strap engagement 126. However, in some embodiments, the cover portion 120 may be integrated into the upper 22. Thus, in such embodiments, the strap 116 may be interspersed or embedded within the upper 22 rather than within the interior cavity 28. Furthermore, in some embodiments, the strap 116 can extend from the strap engagement 126 through the upper 22 along the medial side 64 to the rear end 52, looping around the rear end 52 (i.e., crossing the central axis 66) and back to the lateral side 62 until reaching the strap engagement 126.

In some embodiments, as shown in FIGS. 12 and 13, the strap 116 can extend out of the interior cavity 28, or from within the material of the upper 22, via a first aperture 128 of the upper 22 along the medial side 64 and via an opposite second aperture (not shown) of the upper 22 along the lateral side 62. Accordingly, from the first aperture 128 at the medial side 64, the strap 116 can exit the upper 22 and extend over the exterior surface 74 to the rear end 52, looping around the rear end 52 (i.e., crossing the central axis 66) and back to the lateral side 62 until reaching the second aperture. In some embodiments, the first aperture 128 and the second aperture can be located along the midfoot region 32, as shown in FIGS. 12 and 13. However, in other embodiments, the first aperture 128 and the second aperture can be located along the forefoot region 30 or the heel region 34. Additionally, while the strap 116 is illustrated and described as extending along the medial side 64 and the lateral side 62 and crossing over the central axis 66 by looping around rear end 52, in some embodiments, the strap 116 may cross over the central axis 66 at different and/or multiple locations. For example, the strap 116 may cross over itself, and over the central axis 66, in the midfoot region 32, such as over the bridge 47 of the foot 36 (e.g., similar to the first strap 82 illustrated in FIGS. 1-11). In yet other embodiments, the strap 116 may not cross the central axis 66 but, rather, may be coupled to the upper 22 along the lateral side 62 and along the medial side 64 adjacent the rear end 52.

Still referring to FIGS. 12 and 13, in some embodiments, the upper 22 can include one or more exterior loops 130 coupled to the exterior surface 74 through which the strap 116 may be routed. While one exterior loop 130 is shown in FIGS. 12 and 13 along the rear end 52, additional exterior loops 130 may be positioned along the medial side 64 between the first aperture 128 and the rear end 52, and/or along the lateral side 62 between the second aperture and the rear end 52. Furthermore, while FIGS. 12 and 13 illustrate a portion of the strap 116 extending out over the upper 22, i.e., over the exterior surface 74 of the upper 22, in some embodiments, this portion of the strap 116 may instead be interspersed through or embedded in between material(s) of the upper 22, as noted above, and/or may be interlaced through the upper 22, e.g., extending into and out of the interior cavity 28 via additional apertures.

In any such embodiments, the strap 116 may engage the upper 22, but freely translate relative to the upper 22 in order to move into and out of the first aperture 128 and the second aperture and across or through the upper 22 along the forefoot region 30, the midfoot region 32, and around the heel region 34. As a result, when the rail 114 or, more specifically, the base portion 118, is moved into the first position X, i.e., a "tightened" or "engaged" position, the strap 116 is pulled toward the rail 114 so that it tightens around portions of the upper 22 along the heel region 34 and the midfoot region 32, as shown in FIGS. 12, 14A, and 15B, as the strap 116 loops around the heel region 34 and converges toward the front end 50. When the rail 114 is moved toward the second position Y, i.e., a "loosened" or "at rest" position, the strap 116 is released and allowed to pull away from the rail 114 so that it loosens around portions of the upper 22 along the heel region 34 and the midfoot region 32, as shown in FIGS. 13, 14B, and 15A.

A discrete first position X and second position Y of the base portion 118 of the rail 114 are discussed herein. In some embodiments, the rail 114 may be engaged so that the strap 116 is only tightened once the first position X is reached, and only loosened once the second position Y is reached. However, in other embodiments, the rail 114 may be engaged so that the strap 116 is gradually tightened as the base portion 118 is moved toward the first position X and gradually loosened as the base portion 118 is moved toward the second position Y. In such embodiments, the user can selectively tighten or loosen the strap 116 to a desired state based on moving the base portion 118 relative to the first position X or the second position Y.

In light of the above, some embodiments provide a strap system 26 that can self-tighten around a user's foot 36 based on movement of the user's toes 38 within the interior cavity 28 of the article of footwear 20. The self-tightening is accomplished via a rail 114 engaged with a strap 116 that extends from a front end 50 of the article of footwear 20 to loop around the user's heel 48 at the rear end 52. As a result, tightening of the upper 22 around the user's foot 36 is accomplished by the strap system 26 at the midfoot region 32 and/or the heel region 34 (e.g., around the heel 48). More specifically, the strap system 26 pulls the upper 22 against the user's foot 36 to secure the user's foot 36 within the article of footwear 20.

In some embodiments, the strap system 26 may incorporate additional or other structures to accomplish self-tightening. For example, in some embodiments, the strap 116 may not extend completely around the heel 48. Rather, the strap 116 may be coupled to the upper 22 at the heel region 34 along the lateral side 62 and the medial side 64. When the strap 116 is tightened, it pulls the heel region 34 of the upper 22 at the coupling locations, causing the upper 22 to pull toward the user's heel 48 to secure the foot 36 within the article of footwear 20. Thus, whether the strap 116 completely loops around the heel region 34 or is only coupled to portions of the upper 22 at the heel region 34, tightening is still accomplished by the strap system 26 at the heel region 34. Furthermore, while the strap 116 is illustrated herein as looping around the heel region 34 generally adjacent a user's heel 48, the strap 116 may be additionally or alternatively configured to loop around the heel region 34 within the ankle region 72, generally adjacent the user's ankle 49.

In light of the above, the strap system 26 can therefore secure a user's foot 36 within an article of footwear 20 without the need for traditional lacing or buckling systems. This provides enhanced ease-of-use for individuals with impaired dexterity or ability to reach their feet, in that the article of footwear 20 is self-tightening and a user need not reach down to tie laces or buckle buckles. Furthermore, in some embodiments, the strap system 26 can provide a smooth upper 22 across the entire top of the foot 36 (e.g., as opposed to lacing systems which would interrupt a smooth upper 22). However, in other embodiments, the strap system 26 may be used in conjunction with a lacing or buckling system.

Additionally, in some embodiments, the strap system 26 can include additional locks, buckles, or other mechanisms configured to further tighten and/or maintain the strap 116 in place. For example, in some embodiments, the strap system 26 can include an additional tightening mechanism (such as an additional rotating buckle mechanism, not shown) engaging the strap 116. If a user desires further tightening after the base portion is fully moved to the first position X, the user can engage or twist the tightening mechanism, causing the tightening mechanism to further tighten the strap 116 around the upper 22.

In light of the above, the article of footwear of some embodiments comprises a front end, a rear end, a sole structure, and an upper attached to the sole structure. The upper defines a forefoot region, a midfoot region, and a heel region, and the upper and the sole structure together define an interior cavity. The article of footwear also includes a strap system engaged with the upper, where the strap system comprises a strap extending around the heel region and is configured to tighten portions of the upper in response to the user's foot engaging the strap system within the interior cavity in the forefoot region or the midfoot region. For example, in some configurations, the strap system is configured to tighten portions of the upper in response to the user's midfoot or arch engaging the strap system within the interior cavity in at least the midfoot region such that the user's bodyweight pressing against the strap causes portions of the upper to be tightened. In other configurations, the strap system is configured to tighten portions of the upper in response to the user's toe engaging the strap system within the interior cavity in the forefoot region such that the user's toe movement causes portions of the upper to be tightened.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear for a user, comprising:

a front end;

a rear end;

a sole structure;

an upper attached to the sole structure, the upper defining a forefoot region, a midfoot region, and a heel region of the article of footwear, the upper defining a foot receiving opening, the upper including a first aperture along a medial side forward of the foot receiving opening and a second aperture along a lateral side forward of the foot receiving opening, the upper and the sole structure together defining an interior cavity; and a strap system engaged with the upper, the strap system comprising a strap having a continuous length such that the strap forms a tightening region that is configured to loop around the heel region and is configured to tighten portions of the upper in response to the user's foot directly engaging the strap system within the interior cavity in one of the forefoot region or the midfoot region, wherein the strap system includes a stirrup region that is moveable between a first position suspended within the interior cavity between the upper and the sole structure, and a second position adjacent the sole structure, and wherein movement of the stirrup region from the first position to the second position tightens the tightening region around the heel region, and wherein a first portion of the strap extends from a first end of the stirrup region through the first aperture to the heel region and a second portion of the strap extends from a second end of the stirrup region through the second aperture to the heel region.

2. The article of footwear of claim 1, wherein the strap comprises a tightening region positioned outside the interior cavity and coupled to the stirrup region, the tightening region engaged with the upper in order to cause the upper to tighten around the user's foot along the midfoot region and the heel region of the upper in response to movement of the stirrup region, and wherein the stirrup region comprises a loop that receives the user's foot as it is inserted into the article of footwear.

3. The article of footwear of claim 2, wherein the tightening region crosses over itself in the midfoot region and loops around the heel region.

4. The article of footwear of claim 2, wherein the tightening region includes a crossing portion above the stirrup region, a heel portion adjacent the heel region, a lateral portion that extends from the crossing portion to the heel portion along a lateral side of the upper, and a medial portion that extends from the crossing portion to the heel portion along a medial side of the upper.

5. The article of footwear of claim 2, wherein the tightening region is pulled toward the interior cavity when the loop moves from the first position to the second position, causing the upper to tighten around the user's foot.

6. The article of footwear of claim 2, wherein the loop is positioned within the midfoot region.

7. The article of footwear of claim 2, wherein the tightening region is positioned within the midfoot region and the heel region.

8. The article of footwear of claim 1, wherein the strap is configured to tighten the portions of the upper within the midfoot region and the heel region in response to the user's foot engaging the strap system within the interior cavity.

9. A method of self-tightening an article of footwear to a foot of a user through a strap system engaged with an upper of the article of footwear, the upper defining a foot receiving opening and including a first aperture along a medial side forward of the foot receiving opening and a second aperture along a lateral side forward of the foot receiving opening, the method comprising:

receiving the foot through a stirrup region of the strap system within an interior cavity of the article of footwear, wherein the stirrup region is moveable between a first position suspended within the interior cavity between the upper and a sole structure, and a second position adjacent the sole structure;

causing the stirrup region to press into the interior cavity in response to the user's bodyweight as the foot is pressed against the stirrup region within the interior cavity, thereby moving the stirrup region from the first position to the second position;

pulling a tightening region that is coupled to the stirrup region and positioned within a midfoot region and a heel region of the article of footwear in response to the stirrup region pressing into the interior cavity, wherein a first strap forms the tightening region and has a continuous length such that the first strap is configured to loop around a heel region of the upper, wherein a first portion of the first strap extends from a first end of the stirrup region through the first aperture to the heel region and a second portion of the first strap extends from a second end of the stirrup region through the second aperture to the heel region; and tightening regions of the upper engaged with the tightening region around the foot within the midfoot region and the heel region as a result of the tightening region being pulled, wherein movement of the stirrup region from the first position to the second position tightens the tightening region around the heel region.

10. The article of footwear of claim 1, wherein the first portion of the strap extends from the first end of the stirrup region to the lateral side of the heel region, and the second portion of the strap extends from the second end of the stirrup region to the medial side of the heel region.

11. The article of footwear of claim 1, wherein the first aperture and the second aperture extend entirely through the upper.

* * * * *